US009545635B2

(12) United States Patent
Motadel et al.

(10) Patent No.: US 9,545,635 B2
(45) Date of Patent: Jan. 17, 2017

(54) PIPETTE TIP TRAYS

(75) Inventors: Arta Motadel, San Diego, CA (US); Peter Paul Blaszcak, San Diego, CA (US)

(73) Assignee: BIOTIX, INC., San Diego, CA (US)

( * ) Notice: Subject to any disclaimer, the term of this patent is extended or adjusted under 35 U.S.C. 154(b) by 0 days.

(21) Appl. No.: 13/050,780

(22) Filed: Mar. 17, 2011

(65) Prior Publication Data

US 2011/0236278 A1 Sep. 29, 2011

Related U.S. Application Data

(60) Provisional application No. 61/315,377, filed on Mar. 18, 2010, provisional application No. 61/442,682, filed on Feb. 14, 2011.

(51) Int. Cl.
*B01L 9/00* (2006.01)

(52) U.S. Cl.
CPC ..... *B01L 9/543* (2013.01); *B01L 2200/025* (2013.01); *B01L 2300/041* (2013.01)

(58) Field of Classification Search
CPC ..... B01L 3/0275; B01L 9/543; B01L 9/54; G01N 2035/103
USPC ..... 422/560–569
See application file for complete search history.

(56) References Cited

U.S. PATENT DOCUMENTS 2,526,129 A * 10/1950 Groesbeck ..... E05D 1/02 16/225
D264,810 S 6/1982 Voltmann
D271,239 S 11/1983 Lemieux et al.
4,483,925 A 11/1984 Noack
4,676,377 A 6/1987 Rainin et al.
5,035,326 A 7/1991 Stahl
D337,165 S 7/1993 Malinoff
5,366,088 A * 11/1994 Hill et al. ..... 206/499
5,392,914 A 2/1995 Lemieux et al.
5,470,538 A 11/1995 Lind
5,487,872 A 1/1996 Hafeman et al.
5,588,792 A 12/1996 Tiso
5,622,676 A 4/1997 Lind
5,642,816 A * 7/1997 Kelly et al. ..... 211/60.1
5,779,984 A 7/1998 Kelly et al.
D411,308 S 6/1999 Pandey et al.
D414,271 S 9/1999 Mendoza
D414,561 S 9/1999 Escoffier
D416,330 S 11/1999 Brown
(Continued)

FOREIGN PATENT DOCUMENTS

EP 0 069 419 3/1985
FR 2 784 076 4/2000
(Continued)

OTHER PUBLICATIONS

Corning Deck Works Piptet Tips, Product Brochure 2010.
(Continued)

*Primary Examiner* — Dennis M White
*Assistant Examiner* — Bryan Kilpatrick
(74) *Attorney, Agent, or Firm* — Grant IP, Inc.

(57) ABSTRACT

Provided are pipette tip trays for use in biotechnology applications. In certain embodiments, provided are pipette tip trays having one or more of the following features: (i) lacking an external hinge between the lid and the rack, and (ii) having snap plate fasteners configured to releasably secure a snap plate to a base.

10 Claims, 22 Drawing Sheets

(56) References Cited

U.S. PATENT DOCUMENTS

| | | | | |
|---|---|---|---|---|
| 6,007,779 | A | 12/1999 | Lemieux et al. | |
| D420,142 | S | 2/2000 | Ballin et al. | |
| D420,743 | S | 2/2000 | Monks | |
| 6,019,225 | A | 2/2000 | Kalmakis et al. | |
| 6,221,317 | B1 * | 4/2001 | Carl | 422/564 |
| D448,854 | S | 10/2001 | Kuiper et al. | |
| D461,554 | S | 8/2002 | Lafond et al. | |
| D466,219 | S | 11/2002 | Wynschenk et al. | |
| 6,534,015 | B1 * | 3/2003 | Viot et al. | 422/564 |
| 6,772,899 | B2 * | 8/2004 | Delmon | 220/263 |
| 6,875,405 | B1 | 4/2005 | Mathus et al. | |
| 7,036,667 | B2 | 5/2006 | Greenstein et al. | |
| D529,622 | S | 10/2006 | Hadjis et al. | |
| D533,948 | S | 12/2006 | Schaub et al. | |
| 7,220,590 | B2 | 5/2007 | Moritz et al. | |
| D556,338 | S | 11/2007 | Coulling et al. | |
| D556,339 | S | 11/2007 | Coulling et al. | |
| D562,463 | S | 2/2008 | Berndt et al. | |
| D574,505 | S | 8/2008 | Muller-Cohn et al. | |
| D576,208 | S | 9/2008 | Quercetti | |
| D593,207 | S | 5/2009 | Ayliffe | |
| D632,803 | S | 2/2011 | Motadel et al. | |
| D673,293 | S | 12/2012 | Demas et al. | |
| D673,294 | S | 12/2012 | Motadel | |
| D673,295 | S | 12/2012 | Motadel | |
| D673,296 | S | 12/2012 | Fry et al. | |
| D677,400 | S | 3/2013 | Blaettler et al. | |
| 8,430,251 | B2 | 4/2013 | Fry et al. | |
| 8,460,622 | B2 | 6/2013 | Motadel | |
| D690,027 | S | 9/2013 | Motadel | |
| 8,590,736 | B2 | 11/2013 | Motadel | |
| D697,227 | S | 1/2014 | Motadel | |
| D699,370 | S | 2/2014 | Motadel et al. | |
| D699,371 | S | 2/2014 | Williams et al. | |
| D699,859 | S | 2/2014 | Motadel | |
| 2001/0012492 | A1 | 8/2001 | Acosta et al. | |
| 2003/0129089 | A1 | 7/2003 | Arnold et al. | |
| 2003/0152494 | A1 | 8/2003 | Moritz et al. | |
| 2004/0141887 | A1 | 7/2004 | Mainquist et al. | |
| 2005/0150808 | A1 | 7/2005 | Sarna et al. | |
| 2006/0045815 | A1 | 3/2006 | Hovatter | |
| 2006/0093530 | A1 | 5/2006 | Ueda | |
| 2008/0240999 | A1 | 10/2008 | Timpson et al. | |
| 2009/0092520 | A1 | 4/2009 | Moulton | |
| 2009/0155123 | A1 | 6/2009 | Williams et al. | |
| 2009/0298129 | A1 | 12/2009 | Spence et al. | |
| 2010/0124766 | A1 | 5/2010 | Ng et al. | |
| 2010/0166616 | A1 | 7/2010 | Price | |
| 2010/0221151 | A1 | 9/2010 | Motadel et al. | |
| 2014/0234182 | A1 | 8/2014 | Motadel et al. | |

FOREIGN PATENT DOCUMENTS

| | | |
|---|---|---|
| GB | 1 522 128 | 8/1978 |
| JP | 10-512196 | 11/1998 |
| JP | 2002-528248 | 9/2002 |
| WO | WO 03/064271 | 8/2003 |
| WO | WO 2010/008737 | 1/2010 |
| WO | WO 2010/054337 | 5/2010 |
| WO | WO 2010/085669 | 7/2010 |
| WO | WO 2011/116230 | 9/2011 |
| WO | WO 2011/135085 | 11/2011 |

OTHER PUBLICATIONS

International Search Report and Written Opinion dated Nov. 25, 2011 in International Application No. PCT/US2011/02881 filed: Mar. 17, 2011, and published as: WO 2011/116230 on Sep. 9, 2011.

Office Action mailed on: Oct. 7, 2010 in Design U.S. Appl. No. 29/357,908, filed Mar. 18, 2010 and Issued as: D632,803 on Feb. 15, 2011.

Office Action mailed on Oct. 2, 2013 in Design U.S. Appl. No. 29/385,452, filed Feb. 14, 2011.

Office Action mailed on Oct. 3, 2014 in Design U.S. Appl. No. 29/446,279, filed Feb. 21, 2013.

Office Action mailed on Oct. 14, 2014 in U.S. Appl. No. 13/773,505, filed Feb. 21, 2013.

Office Action mailed on Mar. 27, 2014 in U.S. Appl. No. 13/773,505, filed Feb. 21, 2013.

International Search Report and Written Opinion dated Jun. 12, 2014 in International Application No. PCT/US2014/017409, filed on Feb. 20, 2014 and published as WO 2014/130679 on Aug. 28, 2014.

Extended European Search Report dated Jul. 4, 2014 in European Patent Application No. EP11757020, filed on Mar. 17, 2011 and published as EP 2 547 450 on Jan. 23, 2013.

Office Action mailed on Feb. 18, 2015 in U.S. Appl. No. 13/773,505, filed Feb. 21, 2013 and published as US 2014-0234182 on Aug. 21, 2014.

Office Action mailed on Apr. 13, 2015 in U.S. Appl. No. 13/773,505, filed Feb. 21, 2013 and published as US 2014-0234182 on Aug. 21, 2014.

* cited by examiner

SECTION A-A

DETAIL B

DEATAIL A

SECTION A-A

DETAIL C

SECTIONB-B

DETAIL A

PIPETTE TIP TRAYS

RELATED PATENT APPLICATIONS

This patent application claims the benefit of U.S. provisional application No. 61/315,377, filed Mar. 18, 2010, entitled PIPETTE TIP TRAYS, naming Arta Motadel and Peter Paul Blaszcak as inventors. This patent application also is related to U.S. design patent application Ser. No. 29/357,908, filed Mar. 18, 2010 (now U.S. design Pat. No. D632,803, issued on Feb. 15, 2011), entitled PIPETTE TIP TRAY ASSEMBLY, naming Arta Motadel and Peter Paul Blaszcak as inventors. This patent application also is related to U.S. design patent application Ser. No. 29/385,452, filed Feb. 14, 2011, entitled PIPETTE TIP TRAY ASSEMBLY, naming Arta Motadel and Peter Paul Blaszcak as inventors. This patent application also claims the benefit of U.S. provisional patent application No. 61/442,682, filed Feb. 14, 2011, entitled PIPETTE TIP TRAYS, naming Arta Motadel and Peter Paul Blaszcak as inventors. The entirety of each of the foregoing patent applications is incorporated herein by reference.

FIELD

The technology relates in part to pipette tip trays for use in biotechnology applications.

BACKGROUND

Pipette tips are utilized in a variety of industries that have a requirement for handling fluids, and are used in facilities including medical laboratories and research laboratories, for example. In many instances pipette tips are used in large numbers, and often are utilized for processing many samples and/or adding many reagents to samples, for example.

Pipette tips often are substantially cone-shaped with an aperture at one end that can engage a dispensing device, and another relatively smaller aperture at the other end that can receive and emit fluid. Pipette tips generally are manufactured from a moldable plastic, such as polypropylene, for example. Pipette tips are made in a number of sizes to allow for accurate and reproducible liquid handling for volumes ranging from nanoliters to milliliters.

Pipette tips can be utilized in conjunction with a variety of dispensing devices, including manual dispensers (e.g., pipettors) and automated dispensers. A dispenser is a device that, when attached to the upper end of a pipette tip (the larger opening end), applies negative pressure to acquire fluids, and applies positive pressure to dispense fluids. The lower or distal portion of a dispenser (typically referred to as the barrel or nozzle) is placed in contact with the upper end of the pipette tip and held in place by pressing the barrel or nozzle of the dispenser into the upper end of the pipette tip. The combination then can be used to manipulate liquid samples.

Pipette tips often are shipped, stored and presented to a user or dispenser in trays. A tray often includes a rack and a lid, where the rack includes a base and a plate. The plate, or top, generally includes bores through which pipette tips are inserted partially. A lid sometimes is attached to a rack by a hinge, and a user generally swings the lid open to access pipette tips in the rack for use.

SUMMARY

In some embodiments, provided are pipette tip trays that include: a lid containing an edge and a fastener component in association with the edge of the lid, and a rack in effective connection with the lid, which rack comprises a base that includes sides, a fastener component in association with the rack, and a top that contains an array of bores configured to receive partially inserted pipette tips; where: the fastener component in association with the edge of the lid is releasably secured to the fastener component in association with the rack, the fastener component in association with the edge of the lid is concealed within the rack, and the lid can pivot with respect to the rack around the fastener component in association with the edge of the lid. A fastener component in association with the rack is in association with a side of the base in some embodiments. In certain embodiments, one or more fastener components in association with the rack (e.g., one or more slots) is located on a short side of the rack, and in some embodiments, one or more fastener components in association with the rack (e.g., one or more slots) is located on a long side of the rack. In some embodiments, the fastener component in association with the rack is in association with a step in the rack base, and sometimes the step forms a lip around the base perimeter. In certain embodiments, the fastener component in association with the edge of the lid is a projection fastener component and the fastener component in association with the rack is an orifice fastener component. A projection fastener component sometimes is a tab, and an orifice fastener at times is a slot. In some embodiments, the fastener component in association with the edge of the lid associates with the fastener component in association with the rack in a slidable fit, reversible fit, snap fit, interference fit or combination thereof. In some embodiments, provided are methods that include: providing a pipette tip tray described herein and disengaging the lid from the rack.

In certain embodiments, provided are pipette tip trays that include: a top containing an array of bores, each bore configured to receive a partially-inserted pipette tip; a base having sides, one or more of the sides including a step and a first fastener in association with the step; and a lid that includes a second fastener, where: the first fastener and the second fastener independently are selected from a fastener including a slot and a fastener comprising a tab, the tab is in flexible association with the lid or side, and the first fastener and the second fastener are reversibly engaged. The side in association with the fastener sometimes comprises at least one slot. In some embodiments, the lid comprises at least one tab, and sometimes the tab is in flexible association with the edge of the lid. The lid at times comprises a top and sides, and an edge of one of the sides is in association with the tab. The side in association with the fastener sometimes comprises two slots and the lid comprises two tabs. In some embodiments, the lid comprises a slot and a tab and the side in association with the fastener includes a slot and a tab. In certain embodiments, the step defines a lip, and sometimes the lip comprises the first fastener. The first fastener sometimes is a slot, and at times the lip comprises two or more slots. In some embodiments, engagement of the first fastener with the second fastener conceals the tab. In some embodiments, provided are methods that include: providing a pipette tip tray of any one of the embodiments described herein; and disengaging the first fastener from the second fastener, thereby disengaging the lid from the side that includes the first fastener. In some embodiments a side including the step and a first fastener in association with the step is located on a long side of the tray. In certain embodiments a side including the step and a first fastener in association with the step is located on a short side of the tray.

In some embodiments, provided are pipette tip trays that include: a top containing an array of bores, each bore configured to receive a partially-inserted pipette tip; and a base having sides, each side including an edge in association with a surface of the top, where: the edge of each of two or more of the sides of a base includes a plurality of first fasteners, the surface of the top includes a plurality of second fasteners, and the first fasteners are releasably secured to the second fasteners. In some embodiments, the first fasteners and the second fasteners independently are selected from orifices and projections. The projections at times snap-fit with the orifices. In some embodiments, the orifices comprise a slot, and sometimes, the orifices comprise walls and wall termini. The projections sometimes comprise a barb configured to engage a contact point of a wall, wall terminus or wall and wall terminus of an orifice. In some embodiments, the wall or wall terminus is an external wall or wall terminus and in certain embodiments, the wall or wall terminus is an internal wall or wall terminus. Each projection can comprise two or more barbs. In some embodiments, a projection comprises two, three, four, five, six or more barbs. In certain embodiments, the top is in reversible association with the sides, and sometimes, the top is not irreversibly fixed to one or more of the sides. The top is not welded to one or more of the sides in some embodiments, and the surface of the top at times comprises the projections. An edge of each of the two or more sides comprises the orifices in some embodiments. In certain embodiments, two or more internal walls or wall termini comprise the orifices. The surface of the top sometimes comprises projections and orifices and at times the edge of each of the two or more sides comprise orifices and projections. The surface of the top sometimes comprises projections and at times the orifices comprise two or more internal wall or wall termini. In certain embodiments, provided also are methods that include: providing a pipette tip tray of any one of the embodiments described herein, and disengaging the first fasteners from the second fasteners, thereby disengaging the top from the side(s) of the base.

In certain embodiments, provided are pipette tip trays that include: a top containing an array of bores, each bore configured to receive a partially-inserted pipette tip; a base having sides, one or more sides including a step and a first fastener in association with the step; and a lid that includes a second fastener, where: the first fastener and the second fastener independently are selected from a fastener that includes a slot and a fastener including a tab, the tab is in flexible association with the lid or side, the first fastener and the second fastener are reversibly engaged, the edge of each of two or more of the sides includes a plurality of third fasteners, the surface of the top includes a plurality of fourth fasteners, and the third fasteners are releasably secured to the fourth fasteners. In some embodiments, the third fasteners and the fourth fasteners independently are selected from orifices and projections. The projections sometimes snap-fit with the orifices, and at times the orifices comprise a slot. In some embodiments, the orifices comprise walls and wall termini, and the projections comprise barbs configured to engage contact points in the walls, wall termini or walls and wall termini of the orifices. Each projection comprises two barbs in some embodiments, and in certain embodiments, each projection comprises more than 2 barbs. In some embodiments each projection comprises 4 barbs. The top sometimes is in reversible association with the sides, and in certain embodiments, the top is not irreversibly fixed to one or more of the sides. The top is not welded to one or more of the sides in some embodiments, and the surface of the top sometimes comprises the projections. In certain embodiments, the edge of each of the two or more sides comprises the orifices. In some embodiments, two or more internal walls or wall termini comprise the orifice. The surface of the top sometimes comprises projections and orifices and at times the edge of each of the two or more sides comprise orifices and projections. The surface of the top sometimes comprises projections and at times the orifices comprise two or more internal wall or wall termini. The side sometimes includes at least one slot, and in some embodiments, the lid comprises at least one tab. A tab sometimes is in flexible association with the edge of the lid, and in certain embodiments, the lid comprises a top and sides, and an edge of one of the sides is in association with the tab. The side comprises two slots and the lid comprises two tabs in some embodiments, and in certain embodiments, the lid comprises a slot and a tab and the side includes a slot and a tab. The step at times defines a lip, and sometimes the lip extends around the perimeter of the sides. In some embodiments, the lip comprises the first fastener, and sometimes the first fastener is a slot. The lip can include two or more slots in some embodiments, and sometimes engagement of the first fastener with the second fastener conceals the tab. In certain embodiments, provided also are methods that include: providing a pipette tip tray of any one of the embodiments described herein, and disengaging the first fasteners from the second fasteners, thereby disengaging the top from the side(s). Also, in certain embodiments, provided are methods that include: providing a pipette tip tray of any one of the embodiments described herein, and disengaging the third fasteners from the fourth fasteners, thereby disengaging the top from the side(s). In some embodiments a side including the step and a first fastener in association with the step is located on a long side of the tray. In certain embodiments a side including the step and a first fastener in association with the step is located on a short side of the tray.

In certain embodiments, a pipette tip tray or rack includes pipette tips partially inserted in the bores, or subset of the bores, and sometimes a pipette tip tray or rack contains no pipette tips. A surface of the top sometimes comprises a tube coaxially and concentrically disposed with each bore. In certain embodiments, each tube includes an interior surface that comprises a step configured to provide a seating surface for a seating feature of a pipette tip partially inserted in the bore. Certain embodiments are described further in the following description, examples, claims and drawings.

BRIEF DESCRIPTION OF THE DRAWINGS

The drawings illustrate embodiments of the technology and are not limiting. For clarity and ease of illustration, the drawings are not made to scale and, in some instances, various aspects may be shown exaggerated or enlarged to facilitate an understanding of particular embodiments.

DETAILED DESCRIPTION

Figure 1:
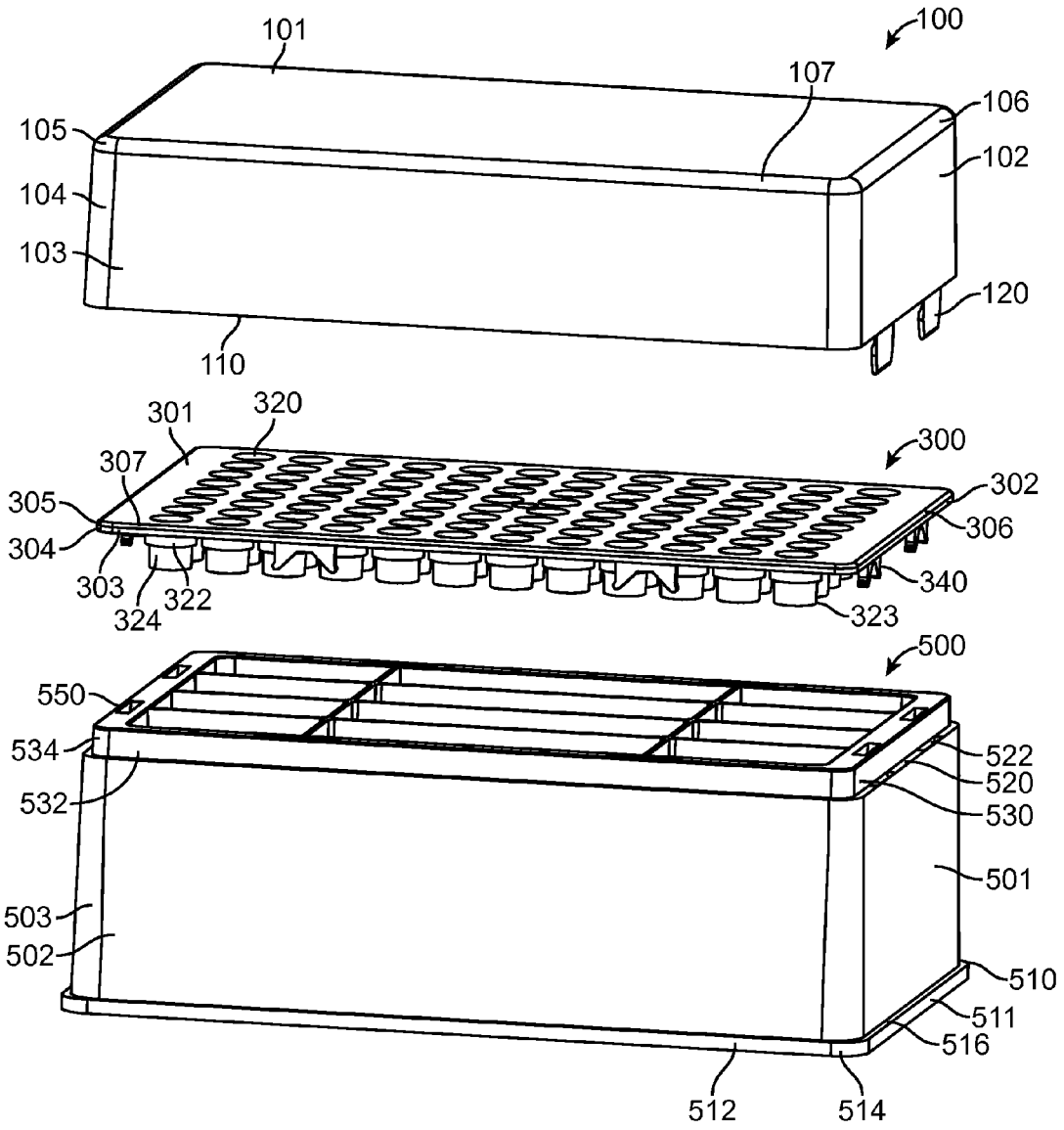
FIG. 1 shows an exploded view of a pipette tip tray.

In certain embodiments, provided are pipette tip trays having one or more of the following features: (i) having an internal, concealed member between the lid and the rack about which the lid can pivot, and (ii) having snap plate fasteners configured to releasably secure a snap plate to a base. Such pipette tip trays confer multiple advantages. For example, trays that include feature (i) can require less plastic for manufacture and often are more compact than trays having an external hinge. These features can impart advantages in packing and shipping, for example. Also, tray embodiments that include fasteners that releasably secure the lid to the rack in connection with feature (i) can be utilized with or without a lid. Further, trays that include feature (ii) can be manufactured efficiently as the plate can be releasably secured to the rack without energy and time required for welding the two components together, for example. Fasteners between the snap plate and the base can be configured for disengagement of a snap plate from a base for trays having feature (ii), and separation can facilitate recycling materials. Other advantageous features of the technology are described hereafter.

Lid and Rack Engagement

A pipette tip tray generally includes a lid and a rack, and a rack includes a top affixed to a base. The top is referred to herein as a "plate" or "snap plate" from time to time, as in some embodiments, a top snaps into the base by engaging certain types of fasteners.

A lid and rack are in flexible association in certain embodiments. A lid can pivot away from the rack around fasteners that releasably secure the lid and rack in some embodiments. In certain embodiments, the lid pivots away from the rack around an edge of the lid and an edge of the rack. The rack and lid generally are in effective connection with one another. Sometimes surfaces of the lid and rack are in direct contact with one another when the lid is in an open or partially open position, and in some embodiments, surfaces of the lid and rack are in proximity to one another when the lid is in an open or partially open position (e.g., surfaces of the lid and rack and in indirect contact and are connected via fastener components in the lid and rack). One side of the lid and one side of the rack often are in effective connection with one another when the lid is in an open or partially open position, and the two elements sometimes are associated by one or more fasteners. A fastener often is an assembly that includes two or more fastener components. A fastener component individually is referred to herein also as a "fastener."

Fasteners in the lid and rack can interact in any convenient arrangement, including without limitation, a slip fit, interference fit, snap fit, locked engagement, removable engagement, reversible engagement, releasable engagement and combinations thereof (e.g., locked engagement and reversible engagement). Any suitable fasteners in the lid and rack can be selected, such as projection-orifice fasteners (e.g., male-female fasteners), for example. Non-limiting examples of projection fasteners include tabs, pins, pegs, barbs, hooks, prongs and the like. A fastener can have any suitable profile, including without limitation, S-shape, J-shape, 1-shape, W-shape, cross or X-shape and Y-shape profiles and the like. A projection fastener sometimes can include one or more terminal projections configured to effect an interference fit or snap-fit (e.g., barb, node, boss and the like), in some embodiments. A projection fastener can include a region of decreased thickness, and/or a region of increased thickness, and sometimes flexes in an area of decreased thickness.

Non-limiting examples of orifice fasteners include apertures, slots, holes, bores, indentations, cross or X-shapes and the like, and projection fastener components generally are configured to mate with a counterpart orifice fastener.

A fastener can be in connection with any suitable portion of the lid (e.g., lid edge 110) and base (e.g., lip). A fastener can be in association with an edge of a lid when the fastener is directly connected to the lid edge or is connected near the lid edge and in proximity to the edge. A fastener can be in association with a rack, and/or in association with a base side. A fastener in association with the rack can be located on or in a structure of the base (e.g., edge, step, lip), and can be located on or in a plate or top in certain embodiments. In some embodiments, a lid can be in effective connection with a short side of a rack having a rectangular top. In certain embodiments, a lid can be in effective connection with a long side of a rack having a rectangular top.

A fastener can be constructed from any suitable material for flexible arrangement between the lid and rack. A fastener sometimes is constructed from a moldable material and sometimes a polymer (e.g., plastic, thermoplastic). Non-limiting examples of moldable materials include polypropylene (PP), polyethylene (PE), high-density polyethylene (HDPE), low-density polyethylene (LDPE), polyethylene teraphthalate (PET), polyvinyl chloride (PVC), polytetrafluoroethylene (PTFE), polystyrene (PS), high-density polystyrene, acrylnitrile butadiene styrene copolymers, cross-linked polysiloxanes, polyurethanes, (meth)acrylate-based polymers, cellulose and cellulose derivatives, polycarbonates, ABS, tetrafluoroethylene polymers, corresponding copolymers, plastics with higher flow and lower viscosity or a combination of two or more of the foregoing, and the like. A fastener can be constructed from the same material, or different material, as the tray element to which the fastener is connected. In some embodiments, a fastener component is constructed from a material different than the material from which its fastener component counterpart is manufactured. A fastener sometimes is manufactured from two or more materials in some embodiments. A lid and a rack are connected by fasteners not configured as an external hinge, in certain tray embodiments. A lid and rack sometimes are connected by fasteners configured as an internal hinge in some embodiments (e.g., FIG. 4C for closed position and FIG. 5C for open position).

When projection-orifice fasteners are connected, a portion of, or all of, the projection fastener often is concealed (e.g., substantially concealed, partially concealed, partially inserted). In some embodiments, a tab in association with the lid can be concealed within a slot in association with the base. A projection fastener can include a flexible feature in some embodiments. A flexible feature sometimes is a seam, indentation, region of thinner thickness, junction and the like. In certain embodiments, a junction between the lid and a tab serves as a flexible joint feature (e.g., hinge feature).

Any suitable number of projection fasteners and orifice fasteners may be utilized. In certain embodiments about 1 to about 100 fasteners can be utilized (e.g., about 2, 3, 4, 5, 6, 7, 8, 9, 10, 20, 30, 40, 50, 60, 70, 80, 90). The number of projection fasteners is equal to or fewer than the number of orifice fasteners in certain embodiments. In some embodiments, a tray has fewer tabs than slots, and sometimes there are slots on each short side of a rack and a lid having tabs can be mounted to either side of the rack. In certain embodiments, the slots are on each long side of a rack and a lid having tabs can be mounted to either long side of the rack. In some embodiments, the slots are on each short side of a rack and a lid having tabs can be mounted to either short side of the rack.

Top and Base Engagement

A top (or plate) generally includes an array of bores, where each bore in the array generally is configured to receive a pipette tip. An array can have any useful number of bores, which sometimes is a multiple of 96 bores (e.g., 192, 288, 384, 576, 672, 768 or 1536). An array can be any suitable two-dimensional array, such as an X by Y array of bores, where X independently is about 2 to about 1,000 bores and Y independently is about 2 to about 1,000 bores (e.g., an 8 by 12 array; 16 by 24 array). An array of bores often includes a regularly spaced set of bores, where the longitudinal axis extending through each bore is spaced equally from other longitudinal axes (e.g., center-to-center distance of about 9 millimeters for 96 bore plates). In embodiments where a rack includes one or more pipette tips, the pipette tips often are inserted partially into bores of the array. In the latter embodiments, portions of a pipette tip typically reside above the plate, are co-extensive with the thickness of the plate, and reside below the plate within the body of the rack. A pipette tip often includes a step that determines the amount of the pipette tip above the plate in embodiments where a pipette tip is inserted partially, and rests, in a bore within the plate.

Any suitable fasteners can be utilized, and any convenient number of fasteners, can be utilized to connect a top and base. A top and base can be releasably secured (e.g., permanent, semi-permanent engagement), where a significant amount of force is required to separate the elements after connection. The elements sometimes are reversibly connected, and can be separated by a separation force greater than a threshold force. In some embodiments, the releasably secured connection is sufficient for retaining the top to the base during shipping and normal use, thereby obviating one or more welds between the two elements (e.g., no sonic weld, adhesive weld). In some embodiments, a tray includes one or more welds (e.g., spot welds, continuous welds) between the top and base.

Fasteners utilized to connect the top and base sometimes form an interference fit. In some embodiments, projection fasteners include one or more barbs that form an interference fit with flexible features in orifice fasteners (e.g., 1 or more, 2 or more, 3 or more, 4 or more, 5 or more, 6 or more, 8 or more, or 10 or more). An example of an interference fit fastener combination is illustrated in FIGS. 7B, 8C, 8D, 11C, 11D, and 12. The fasteners illustrated in FIGS. 7B, 8C, 8D, 11C, 11D, and 12 can have any suitable number of barbs and can be used to attach a tray top to a tray base for any suitable application (e.g., pipette tip tray rack, test tube rack, micro-centrifuge tube rack, the like or combinations thereof). An example of a 4 barb fastener embodiment is shown in FIGS. 20A-22C.

Examples of Pipette Tip Tray Features

Figure 13:
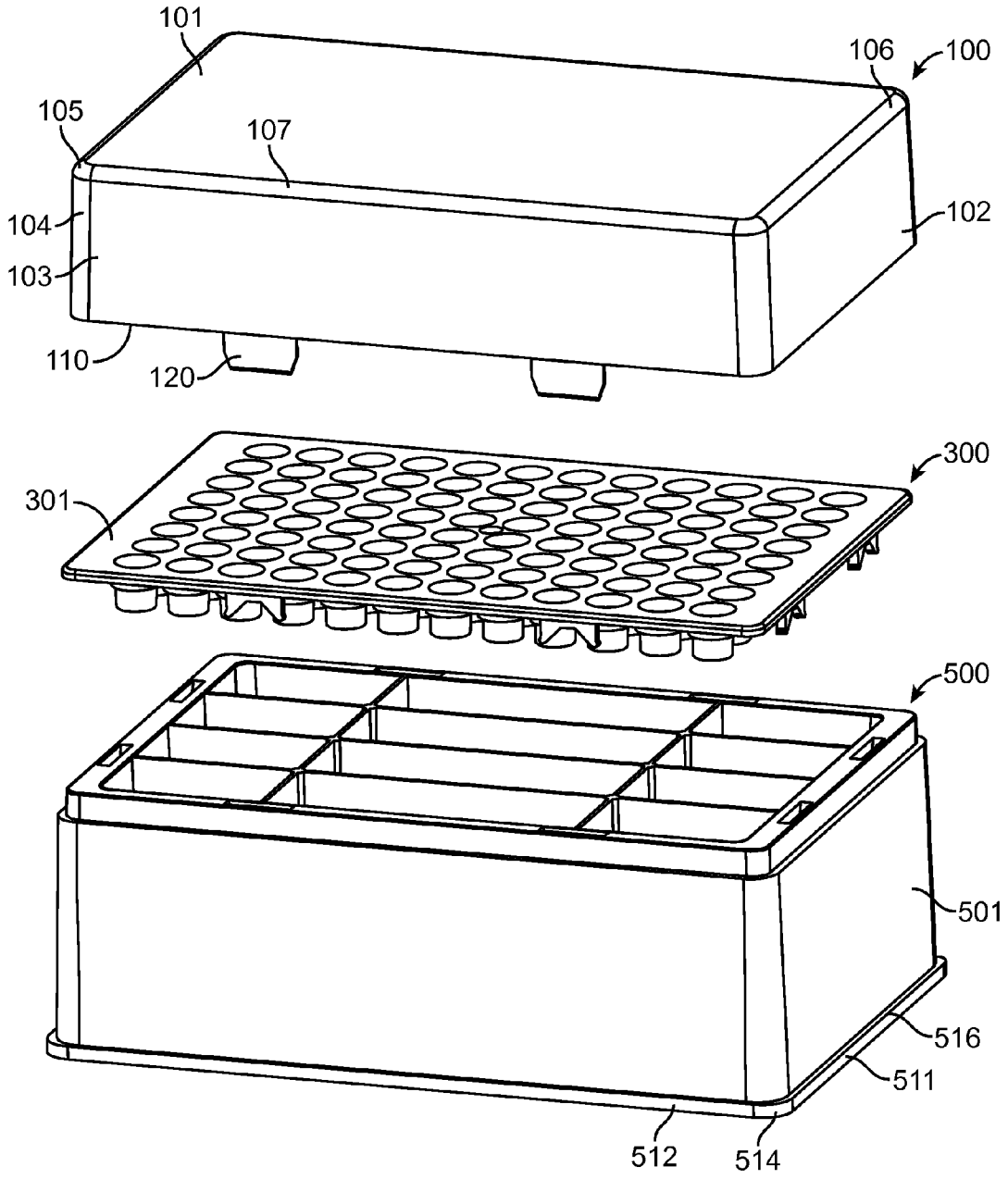
FIG. 13 shows an exploded view of a pipette tip tray.
Figure 14:
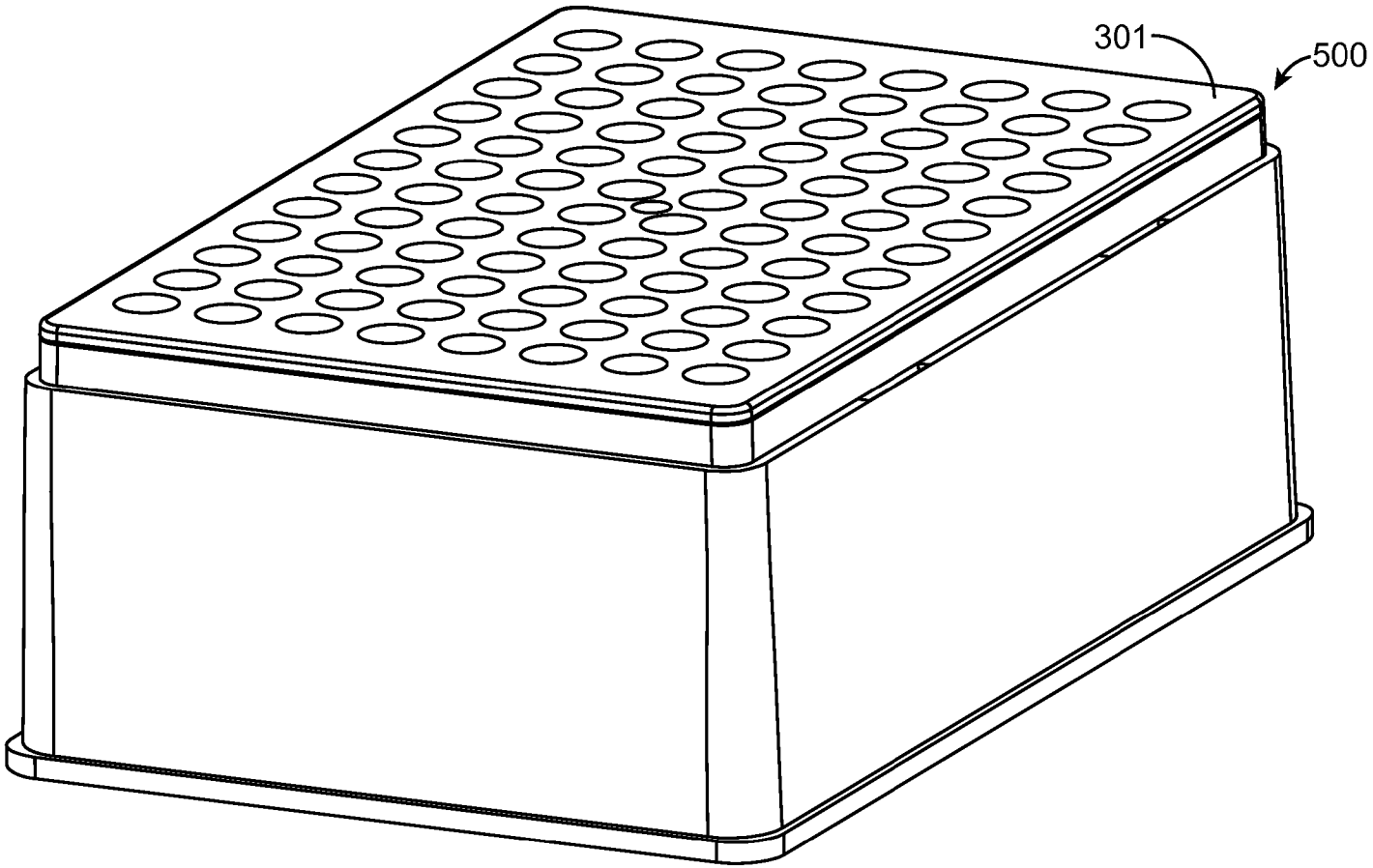
FIG. 14 shows a perspective view of a tray base.
Figure 15:
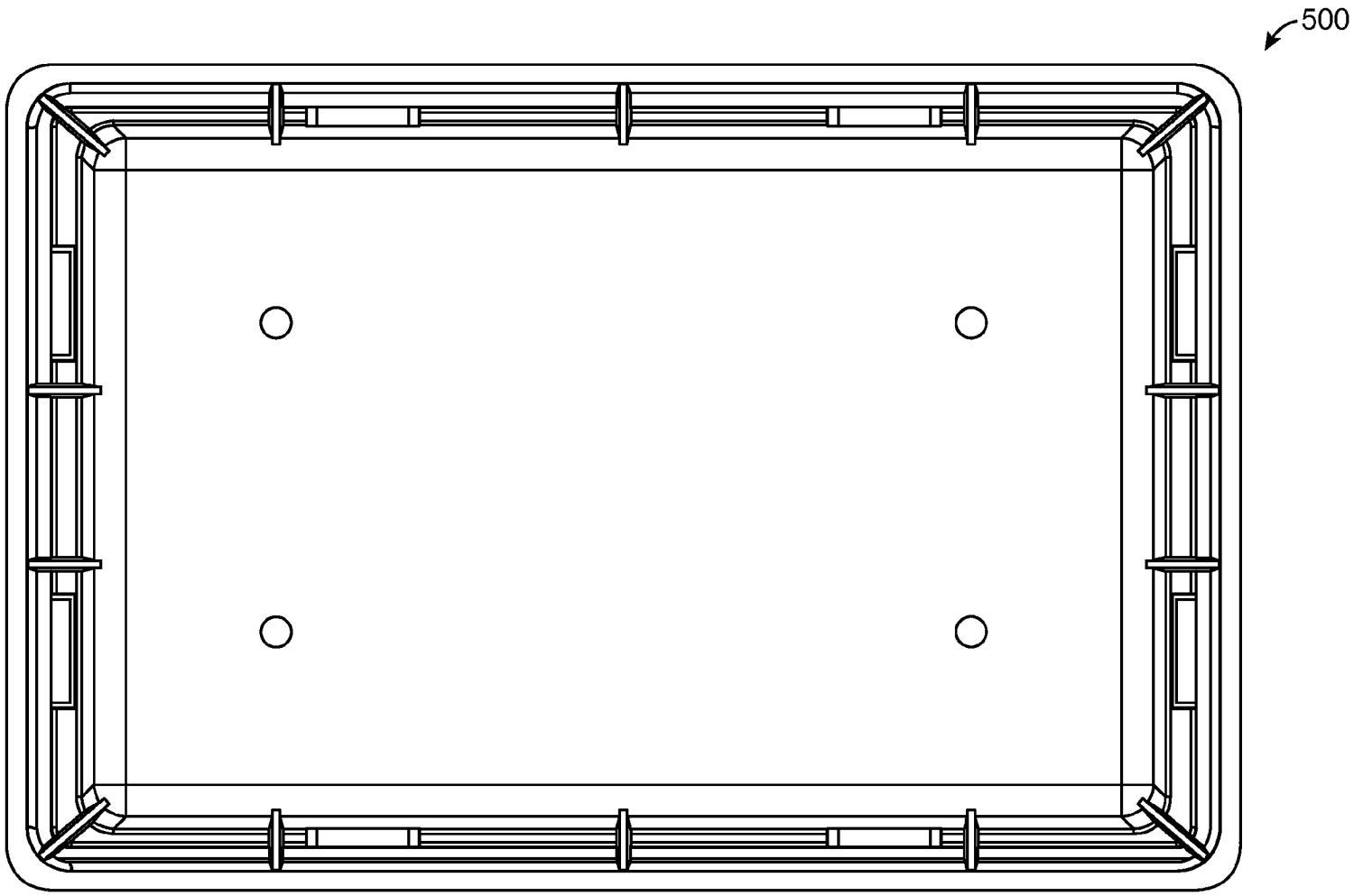
FIG. 15 shows a bottom view of a tray base.
Figure 16:
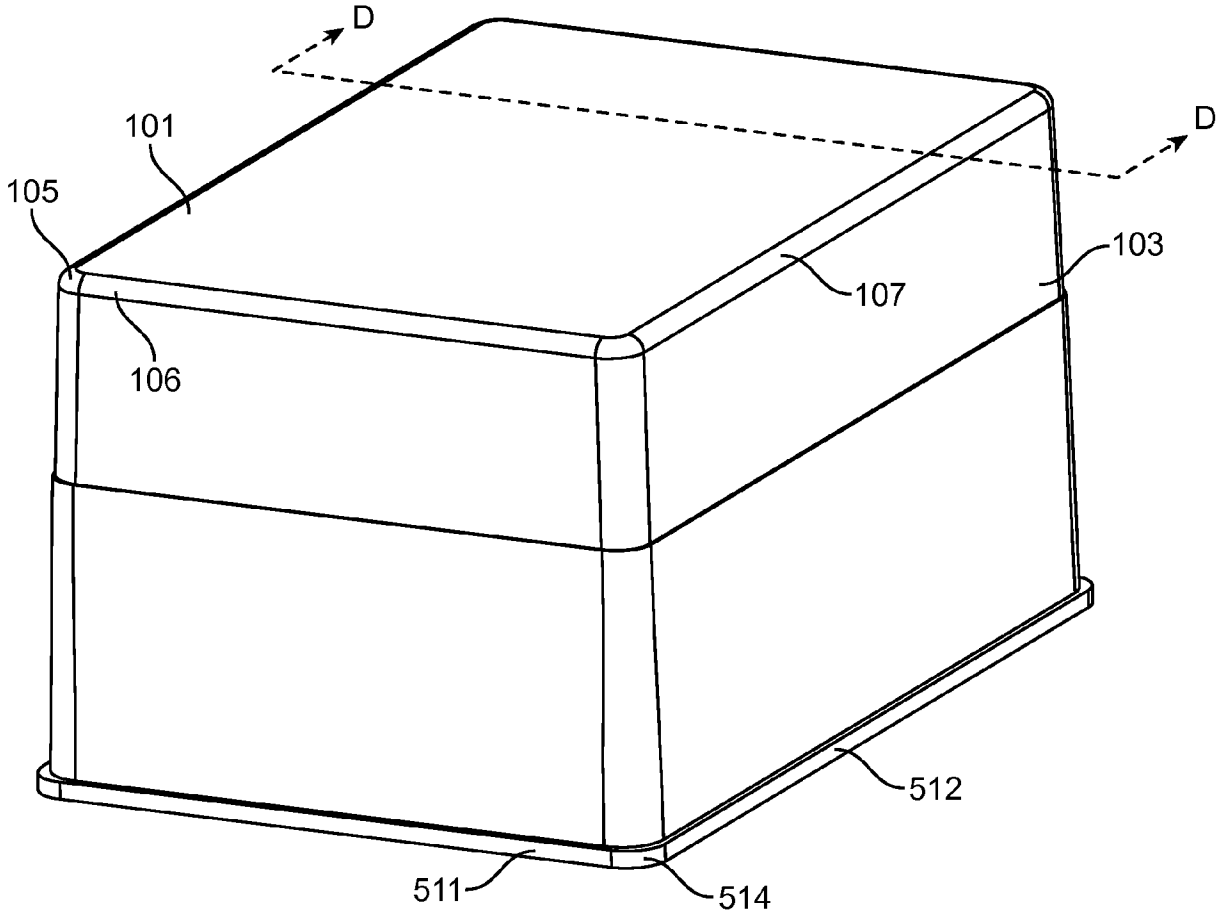
FIG. 16 shows a side perspective view of a pipette tip tray with the lid in a closed position.

Certain non-limiting pipette tip tray features for particular tray embodiments are shown in the drawings. The figures show tray embodiments that include 96 bores configured to receive pipette tips, and it is understood that the number of bores can be readily altered (e.g., trays having 192, 288, 384, 576, 672, 768 or 1536 bores). It is also understood that certain fastener features described herein can engage a snap-plate with a base in pipette tray and tube rack embodiments. FIGS. 1 and 13 show an exploded view of a pipette tip tray embodiment, having a lid 100, a top (plate) 300 and a base 500. The top 300 and base 500 in combination form a rack 70, and the rack 70 and lid 100 in combination form a tray 50.

Also shown in lid 100 of FIGS. 1 and 13 are top 101, shorter side 102, longer side 103, rounded corner 104 between sides 102 and 103, and rounded edge 105 between shorter, rounded edge 106 and longer rounded, edge 107. Also shown is bottom edge 110 and tabs 120 in association with the bottom edge.

As shown in plate 300 in FIGS. 1 and 13 are top surface 301, shorter edge 302, longer edge 303, and shorter edge to longer edge junction 304. Also shown is shorter top surface to edge transition 306, longer top surface to edge transition 307 and rounded transition 305 between these elements. Plate 300 in FIGS. 1 and 13 also illustrate bores 320, and tubes 323 having tube members 322 and 324. Plate 300 shown in FIGS. 1 and 13 also includes fasteners 340 that can releasably secure plate 300 to base 500 in a rack assembly 70.

Base embodiment 500 shown in FIGS. 1 and 13 includes shorter side 501, longer side 502, and rounded corner 503 between sides 501 and 502. Shown also is foot 510 that includes surface 516 that forms a rim around the base, shorter edge 511, longer edge 512 and rounded corner between edges 511 and 512. Also shown are step 520, which forms a lip around the base perimeter, and slot fasteners 522, configured to receive the tab fasteners 120 of the lid. Base embodiment 500 shown in FIGS. 1 and 13 also includes relieved shorter surface 530 (e.g., offset from side 501), relieved longer surface 532 (e.g., offset from side 502) and rounded corner 534 between surfaces 530 and 532. Also included in base 500 are slot fasteners 550 configured to receive projection fasteners 340 of plate 300.

Figure 2:
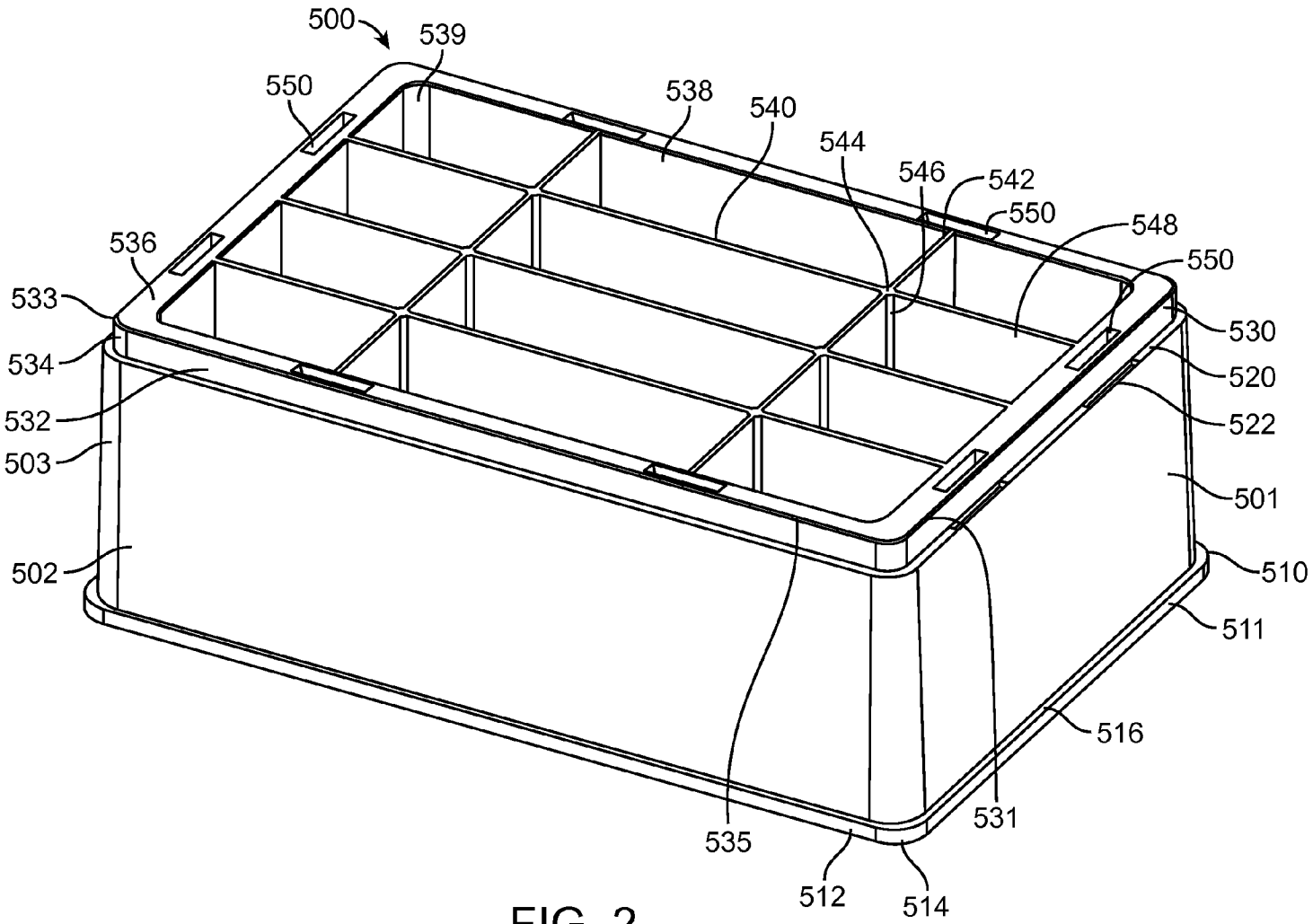
FIG. 2 shows a perspective view of a tray base.

FIG. 2 shows a perspective view of a tray base. Shown are top surface 536, rounded edge transitions 531, 535 and 533 between the top surface 536 and relieved surfaces 530, 532 and 534, respectively. Also shown are inner wall surface 538 and inner surface 539 of rounded corner 503. FIG. 2 also illustrate rib members 540, perpendicular rib members 542 and rib junctions 544, which are cylindrical in certain embodiments.

Figure 3A:
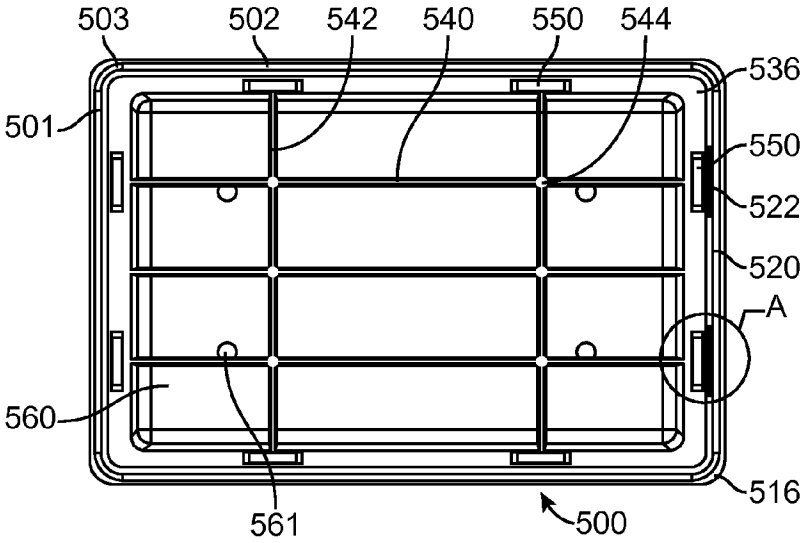
FIG. 3A shows a top view of a tray base.
Figure 3B:
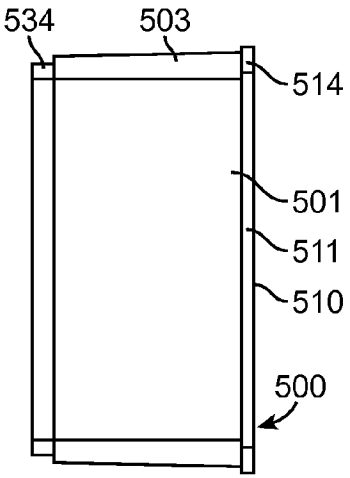
FIG. 3B shows first side view of a tray base.
Figure 3C:
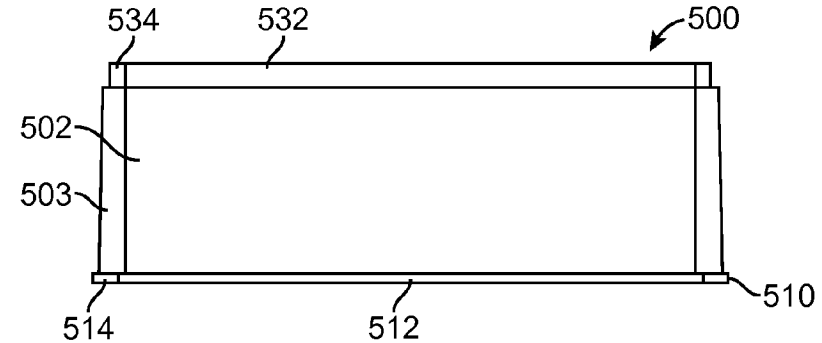
FIG. 3C shows a second side view of a tray base.
Figure 3D:
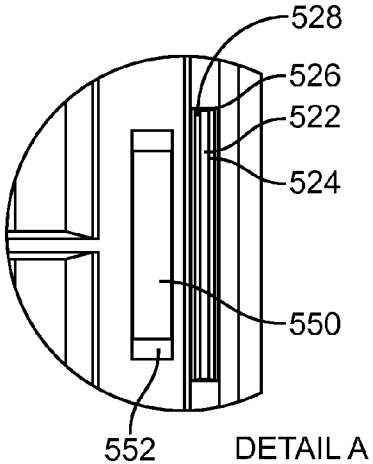
FIG. 3D shows an expanded detail view of a portion of the tray base highlighted in FIG. 3A.

FIG. 3A shows a top view of a tray base 500 with dimples 561 on bottom surface 560, FIG. 3B shows first side view of a tray base, FIG. 3C shows a second side view of a tray base, and FIG. 3D shows an expanded detail view of a portion of the tray base highlighted in FIG. 3A. FIG. 3D shows angled, inner surfaces (e.g., beveled surfaces) 524, 526 and 528 of slot fasteners 522, and angled inner surfaces (e.g., beveled surfaces) 552 of slot fastener 550.

Figure 4A:
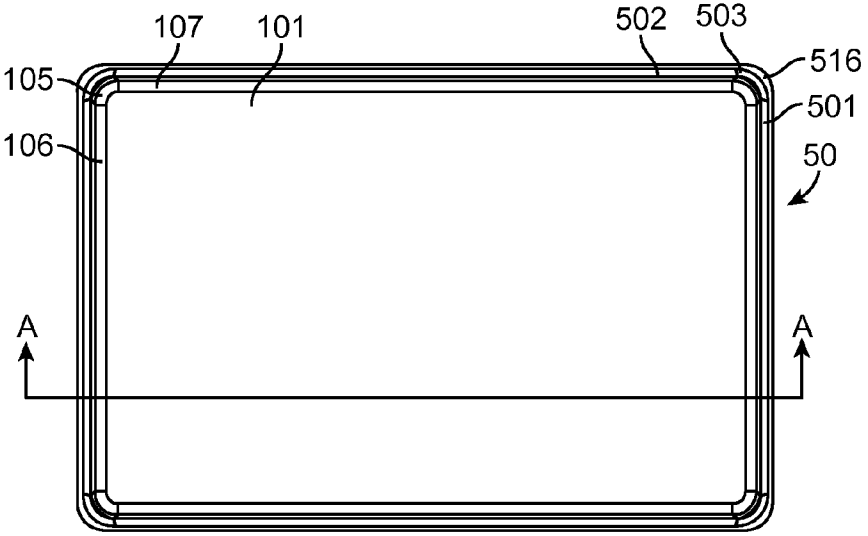
FIG. 4A shows a top view of a rack.
Figure 4B:
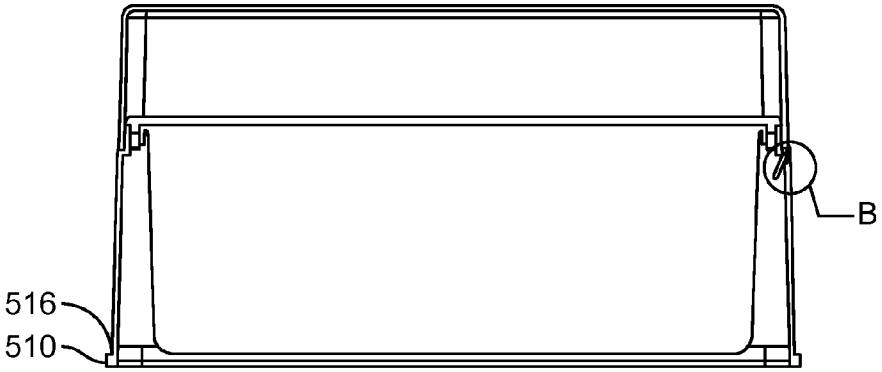
FIG. 4B shows a cross section view of the rack denoted from the perspective A shown in FIG. 4A.
Figure 4C:
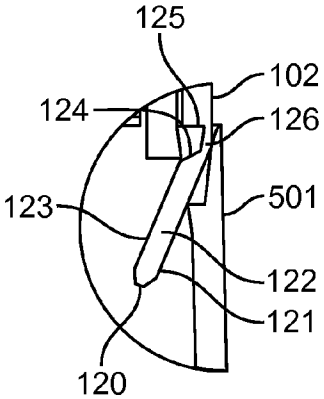
FIG. 4C shows an expanded detail view of a portion of the rack shown in FIG. 4B.

FIG. 4A shows a top view of a tray, FIG. 4B shows a cross section view of tray 500 denoted from the perspective A shown in FIG. 4A, and FIG. 4C shows an expanded detail view of a portion of the tray shown in FIG. 4B. FIG. 4C shows engagement of tab fastener 120 of the lid with slot fastener 522 of the base where the lid is in a closed position with respect to the rack, and illustrates edge surface 125 of edge 110 of the lid, tab connector 126, tab outer surface 121, tab inner surface 123 and tab body 122.

Figure 5A:
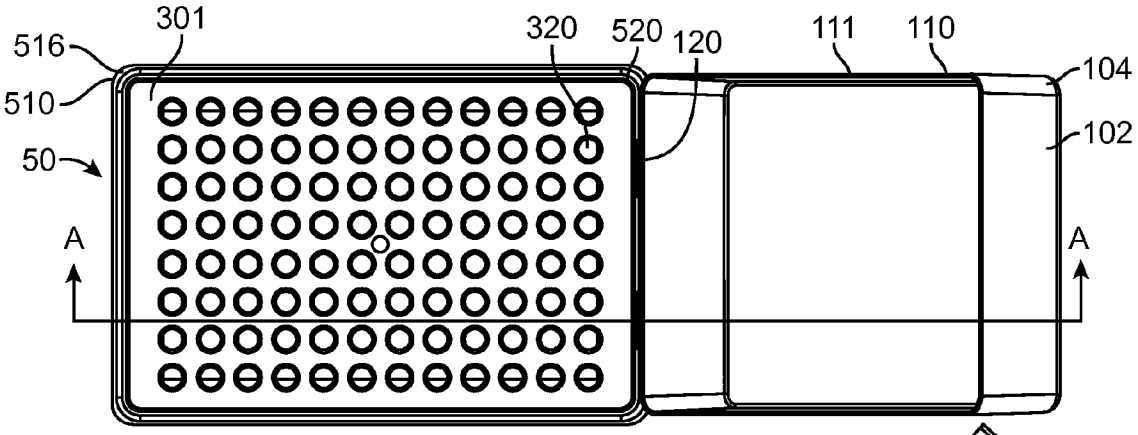
FIG. 5A shows a top view of a tray with the lid in an open position with respect to the rack.
Figure 5B:
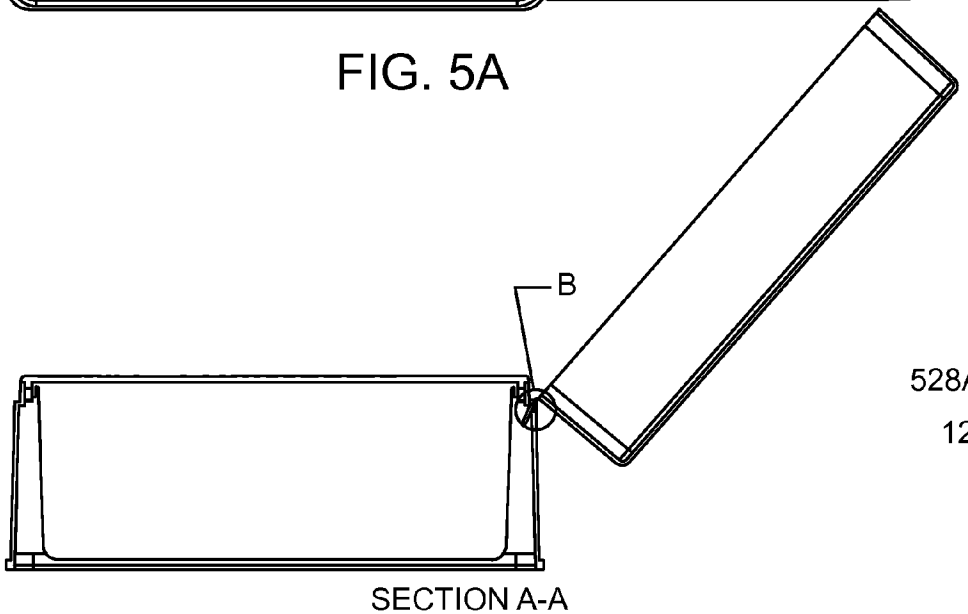
FIG. 5B shows a cross section view of the tray denoted from the perspective A shown in FIG. 5A.
Figure 5C:
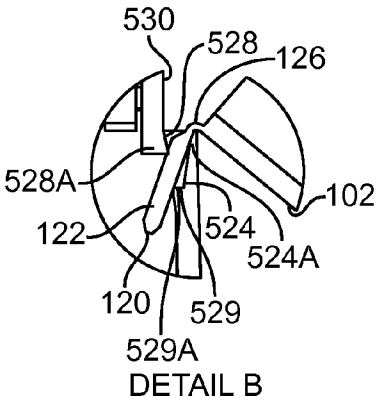
FIG. 5C shows an expanded detail view of a portion of the tray shown in FIG. 5B.
Figures 18A, 18B, 18C:
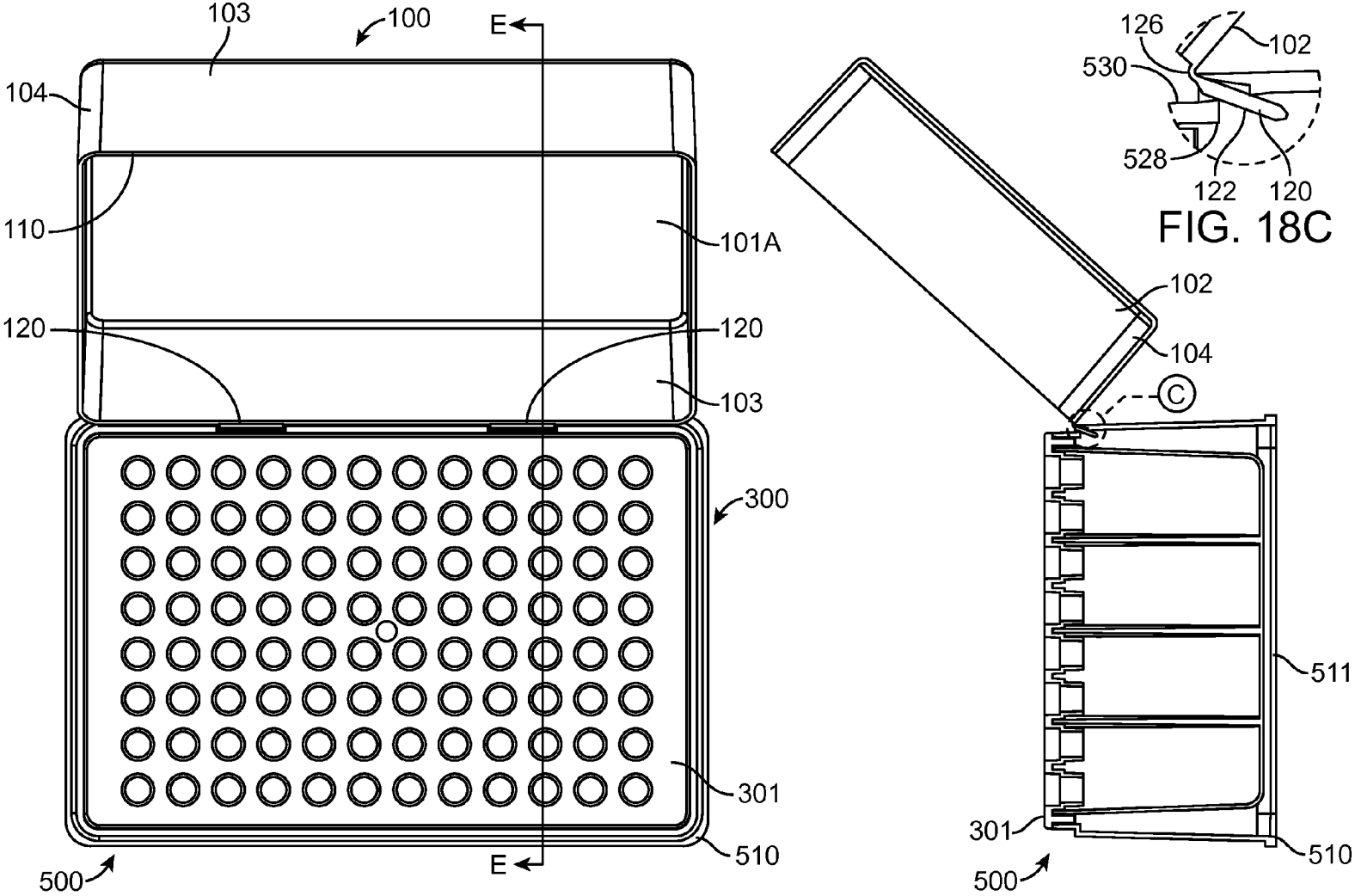
FIG. 18A shows a top view of a pipette tip tray with the lid in an open position.
FIG. 18B shows a cross section view of the tray taken along the line E-E shown in FIG. 18A.
FIG. 18C shows an enlarged view of detail region C shown in FIG. 18B.

FIGS. 5A and 18A show a top view of a tray 50 with a lid in an open position with respect to the rack, FIGS. 5B and 18B show a cross section view of the tray denoted from the perspective A shown in FIG. 5A and the perspective E shown in FIG. 18A. FIGS. 5C and 18C show an expanded detail view of a portion of the tray shown in FIGS. 5B and 18B. Shown in FIGS. 5C and 18C are tab connector 126 in a flexed position, surface 530 of the base, angled inner surface 528 within slot 522 (e.g., angled with respect to side 501) terminating at point 528A in contact with tab body 122, angled inner surface 524 (e.g., angled with respect to side 501) terminating at point 524A in contact with tab body 122, and step 529 of the base that terminates at point 529A, which also is in contact with the tab body. Contact points 524A, 528A and 529A secure the position of tab body 122 and allow lid 100 to pivot around tab connector 126 when the lid is opened into an open position with respect to the rack. A rack fastener can provide any suitable number of contact points for securing a lid fastener, and sometimes a lid fastener is secured by 1, 2, 3, 4, 5, 6, 7, or 9 contact points or contact surfaces within a rack fastener. A rack fastener configured to engage a lid fastener can include one or more angled surfaces (e.g., 1, 2, 3, 4, 5, 6, 7 or 8 angled surfaces), and the angle of each surface independently is selected from an angle of about 5 degrees to about 85 degrees with respect to a wall surface (e.g., 530, 501).

Figure 6A:
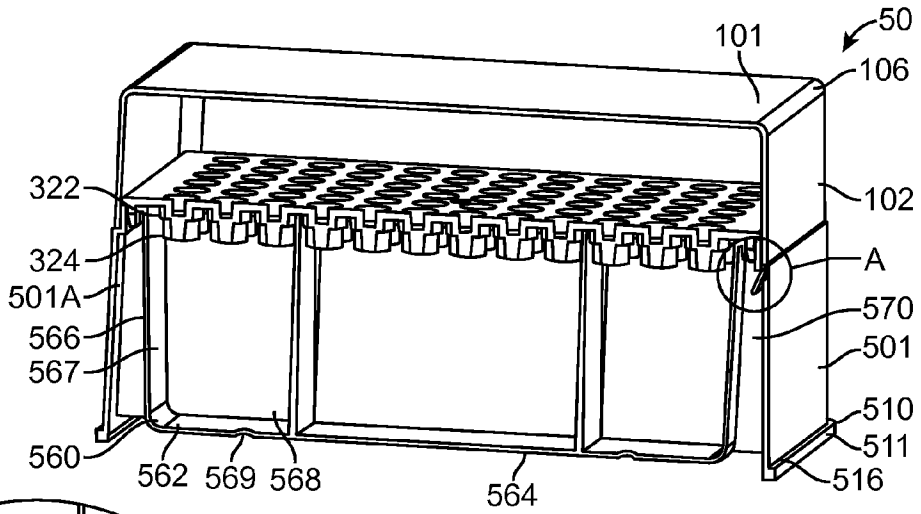
FIG. 6A shows a cross section view of a pipette tip tray with a lid in a closed position.
Figure 6C:
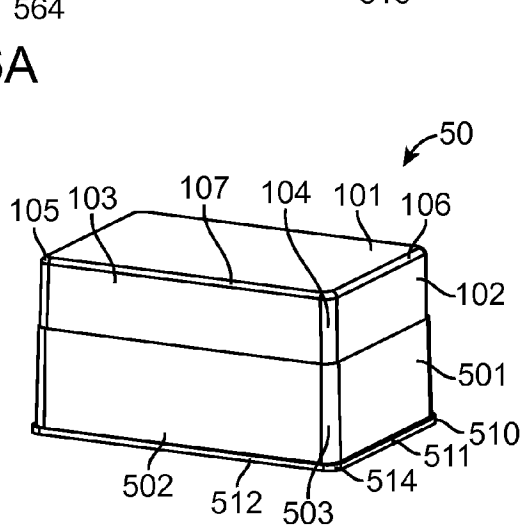
FIG. 6C shows a perspective view of an internal lid hinge embodiment.
Figure 6B:
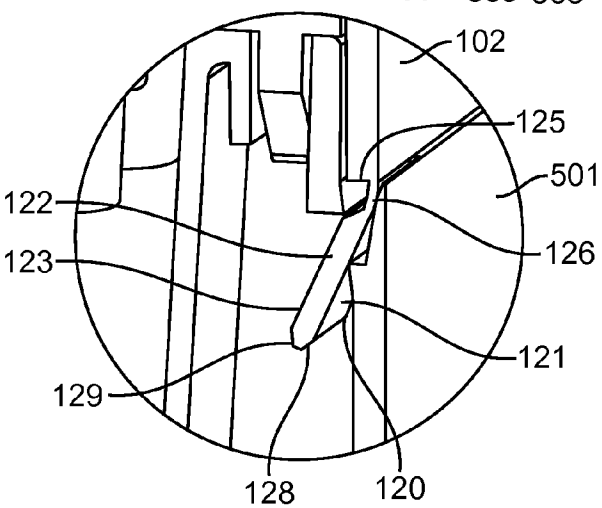
FIG. 6B shows an expanded detail view of a portion of the tray shown in FIG. 6A.
Figure 17A:
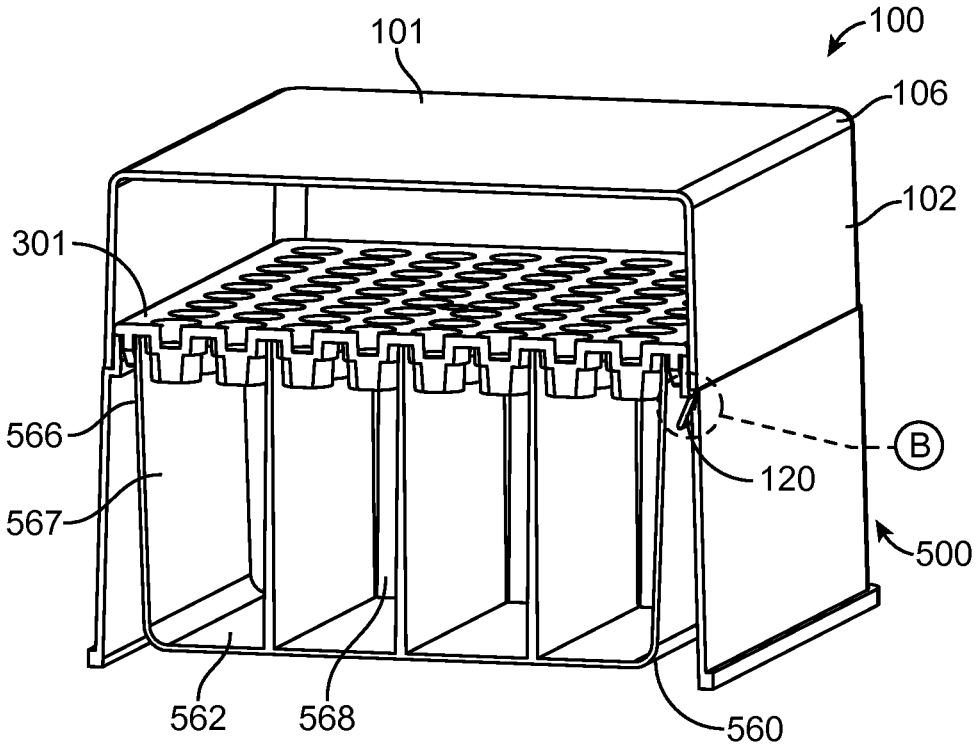
FIG. 17A shows a cross section view of the tray taken along the line D-D shown in FIG. 16.
Figure 17B:
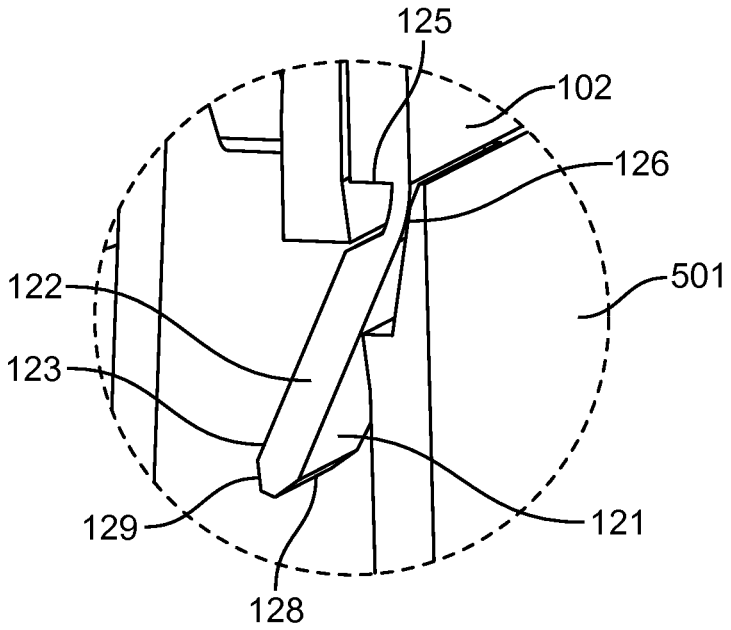
FIG. 17B shows an enlarged view of detail region B shown in FIG. 17A.

FIGS. 6A and 17A show a cross section view of a pipette tip tray with a lid in a closed position, FIGS. 6B and 17B show an expanded detail view of a portion of the tray shown in FIGS. 6A and 17A. FIG. 6C shows a perspective view of an internal lid hinge embodiment. Shown in FIG. 6A, FIG. 17A or FIG. 6A and FIG. 17A are pipette tip containment section walls 566, containment section wall interior surfaces 567, containment section wall to containment section bottom rounded corner 560, interior containment section bottom surface 562, dimple 569 and containment section interior void 568. FIGS. 6B and 17B show tab body surface 121 and opposite tab body surface 123, and tab body terminal bevels 128 and 129. Such bevels can facilitate connection of tabs 120 with slots 522. Also shown is rack wall inner surface 510A to containment section connector rib 570.

Figure 7A:
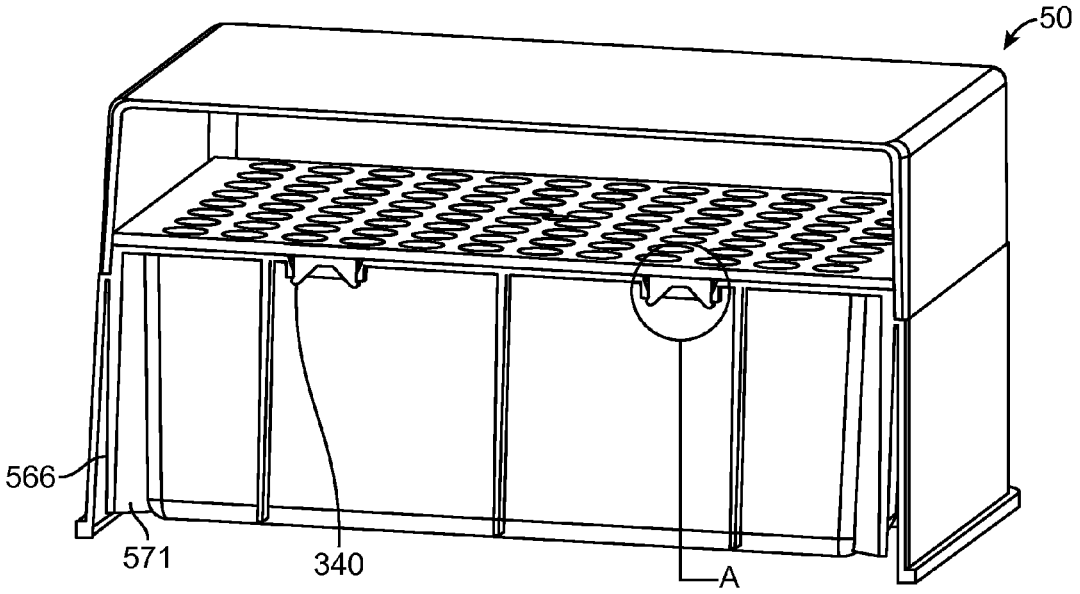
FIG. 7A shows a cross section view of a pipette tip tray with a lid in a closed position.
Figure 7B:
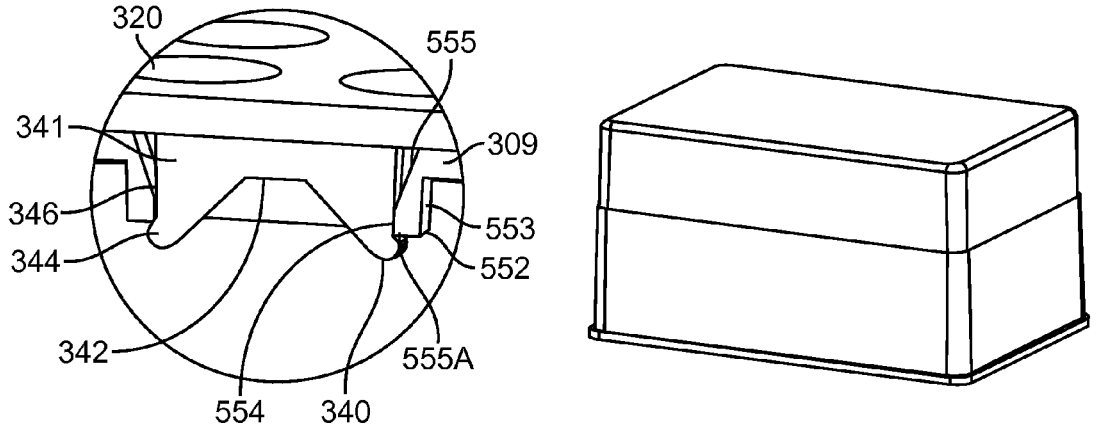
FIG. 7B shows an expanded detail view of fasteners that releasably secure a snap plate to a base.

FIG. 7A shows a cross section view of a pipette tip tray with a lid in a closed position, and FIG. 7B shows an expanded detail view of fasteners that releasably secure a snap plate to a base. FIG. 7A shows containment section to rack wall connector rib 571 having cross section thickness 566. FIG. 7B shows plate fastener 340 engaged with base fastener 550, and angled inner surface 555, plate fastener contact surface 554, and thickness 553 within base fastener 550. A rack fastener configured to engage a plate fastener can include one or more angled surfaces (e.g., 1, 2, 3, 4, 5, 6, 7 or 8 angled surfaces), and the angle of each surface independently is selected from an angle of about 5 degrees to about 85 degrees with respect to a wall surface (e.g., 530, 501). Also shown in FIG. 7B are fastener body 341, barb 344 and spacer 342 of plate fastener 340. In certain embodiments, barb 344 deflects surface 554 of slot 550 away from its resting position as the plate fastener is engaged with the base fastener, and surface 554 relaxes back to its resting position on edge 346 of fastener 340 when the fastener 340 is fully engaged with slot 550 and barb 344 is positioned past the terminus 555A of slot 550.

Figure 8C:
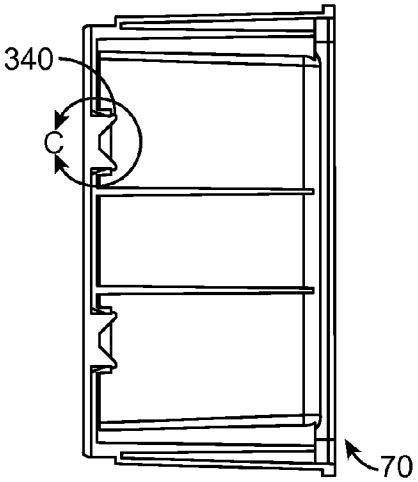
FIG. 8C shows a second cross section view of a rack.
Figure 8D:
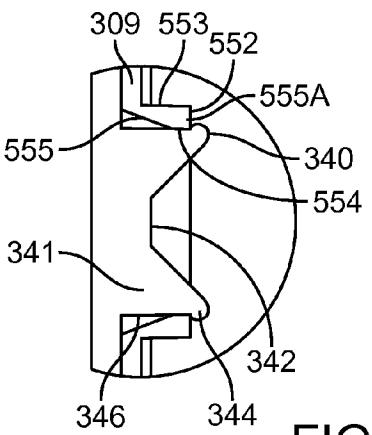
FIG. 8D shows an expanded detail view of fasteners that releasably secure a snap plate to a base.
Figure 8A:
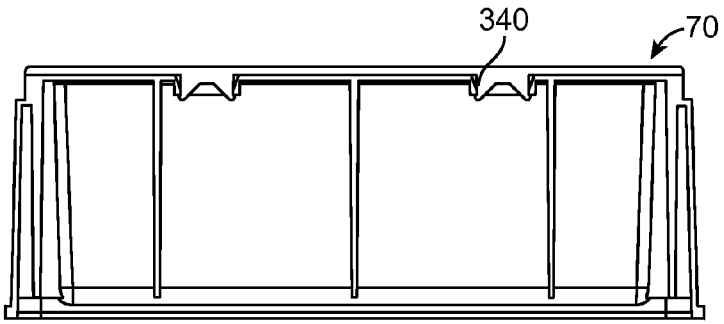
FIG. 8A shows a first cross section view of a rack.
Figure 8B:
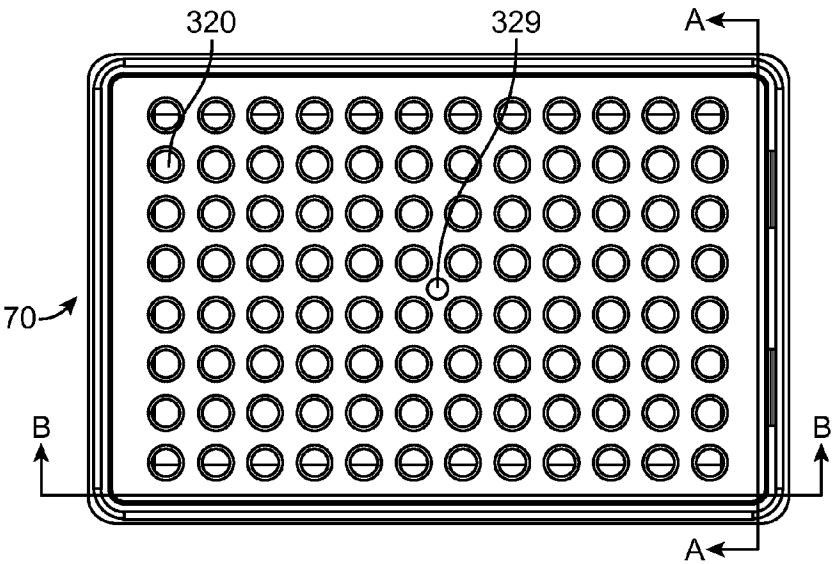
FIG. 8B shows a top view of a rack.

FIG. 8A shows a first cross section view of rack 70, FIG. 8B shows a top view of a rack, FIG. 8C shows a second cross section view of a rack, and FIG. 8D shows an expanded detail view of fasteners configured to releasably secure a snap plate with a base. A description above regarding engagement of base fastener 550 and plate fastener 340 with respect to FIG. 7B is applicable to FIG. 8C.

Figure 9:
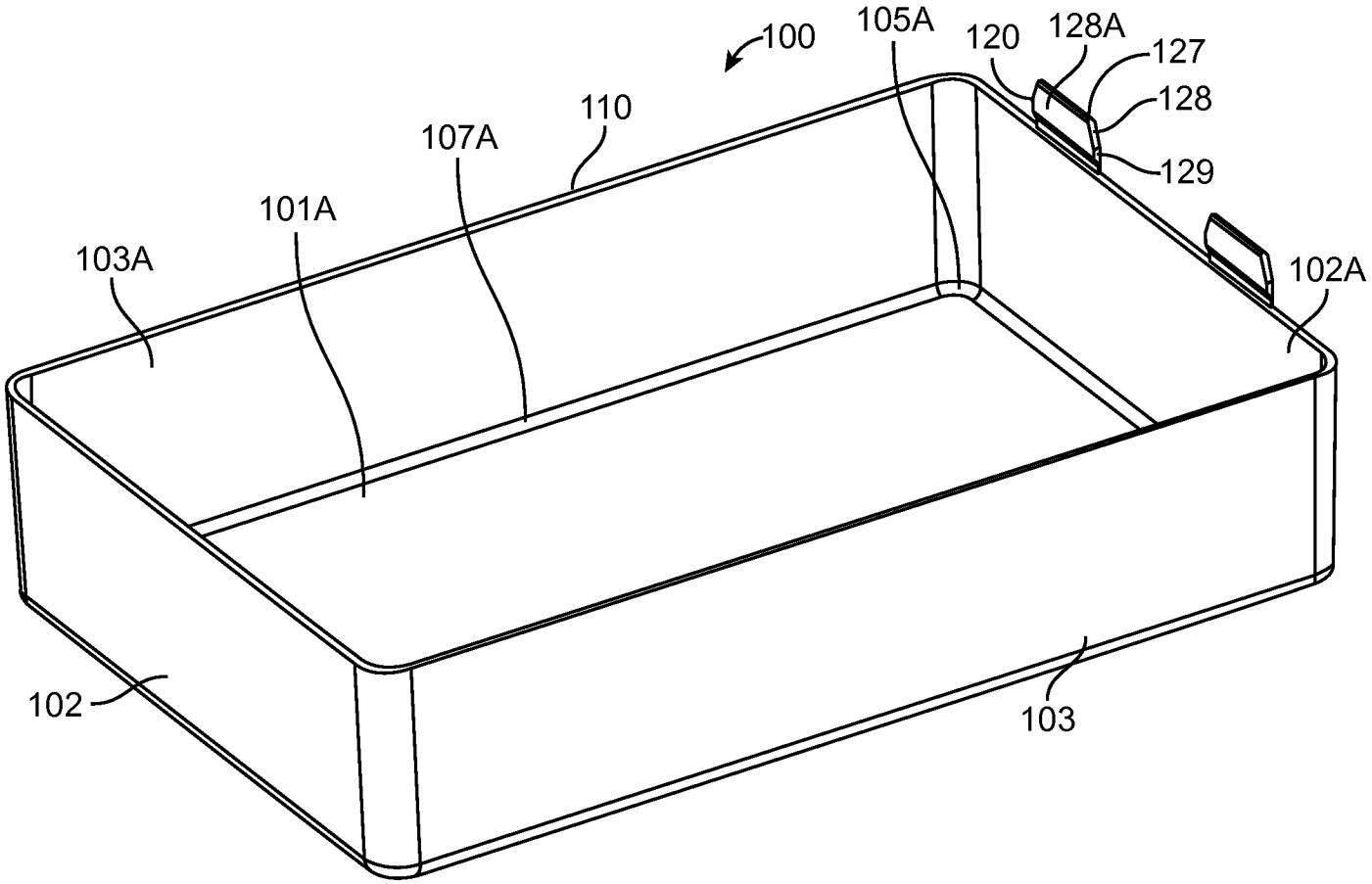
FIG. 9 shows a perspective view of a lid.
Figure 19:
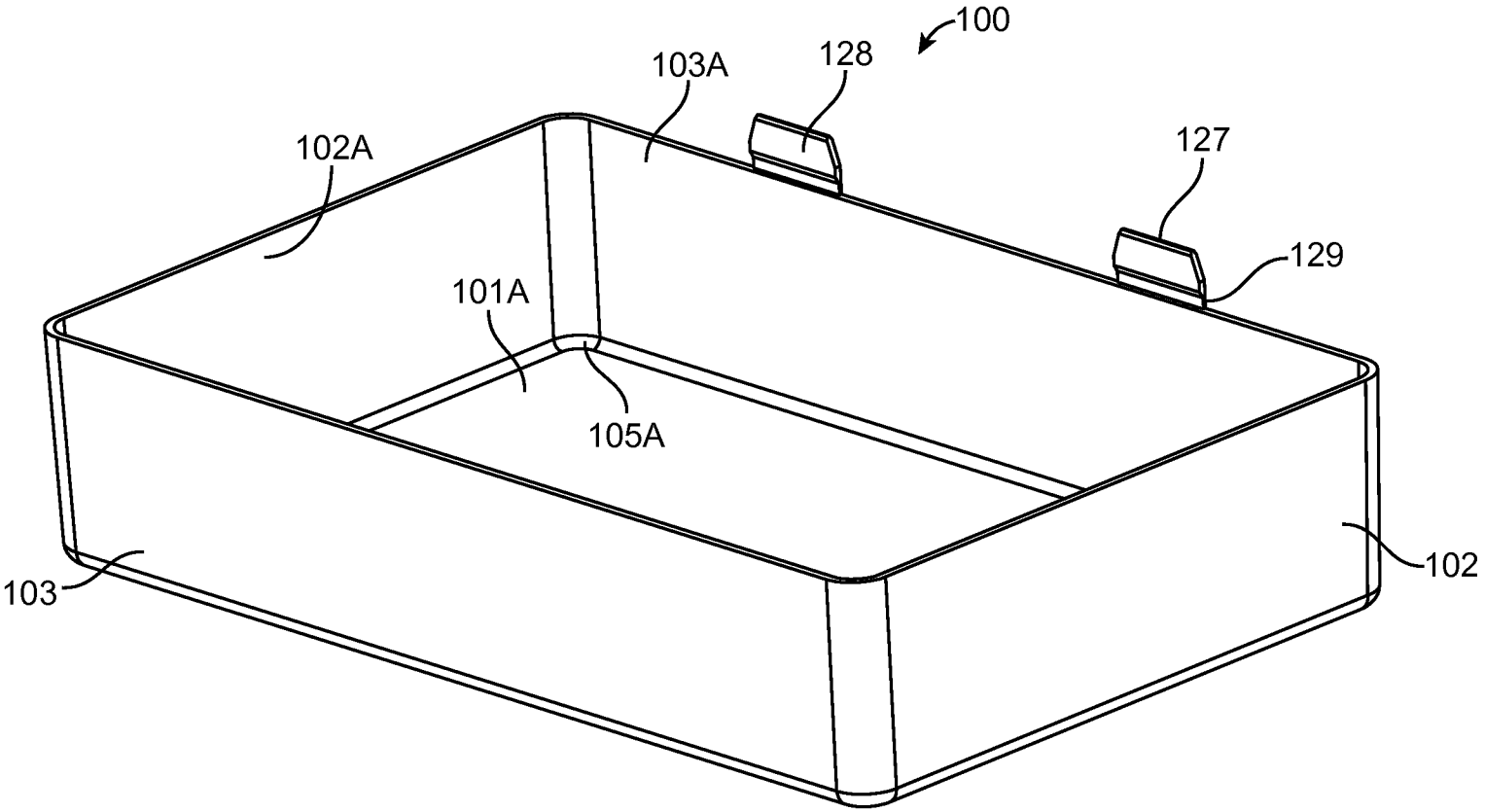
FIG. 19 shows a perspective view of a lid.

FIGS. 9 and 19 show a perspective view of the interior of a lid, with interior counterparts 101A, 102A, 103A, 105A and 107A of exterior surface features 101, 102, 103, 105 and 107, respectively, are shown. Certain features of tab 120 also are shown, including terminal edge 127, angled side 128, non-angled side 129 and tab body 128A.

Figure 10C:
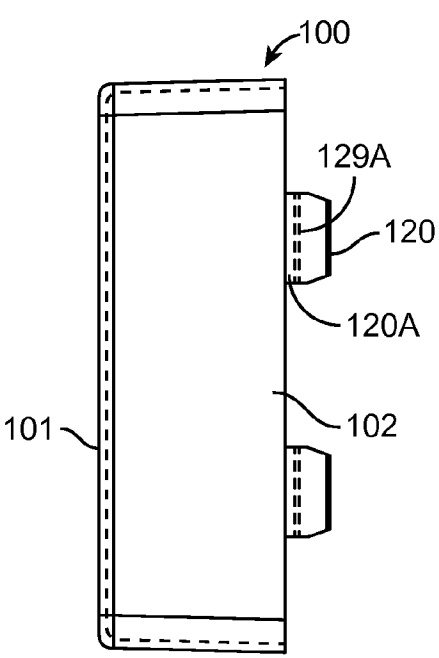
FIG. 10C shows a second side view of a lid.
Figure 10A:
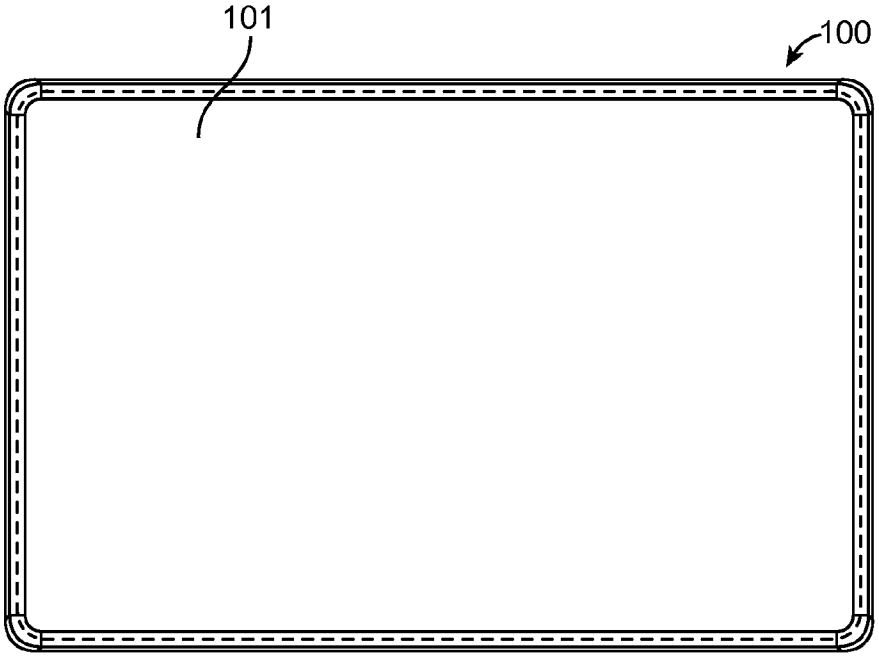
FIG. 10A shows a top view of a lid.
Figure 10B:
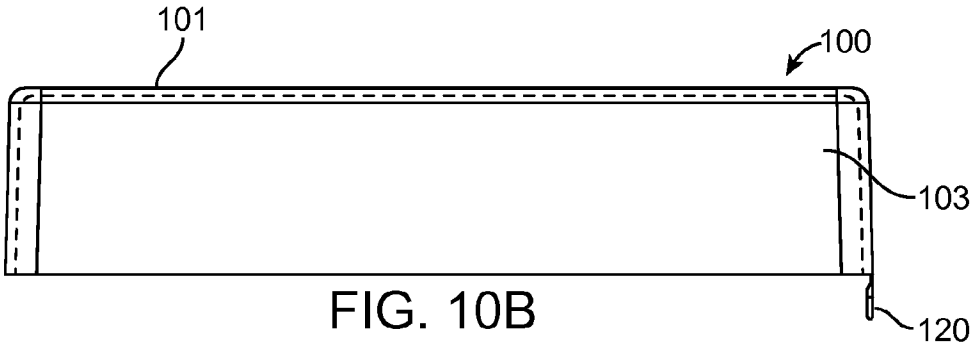
FIG. 10B shows a first side view of a lid.

FIG. 10A shows a top view of a lid, FIG. 10B shows a first side view of a lid and FIG. 10C shows a second side view of a lid. FIG. 10C illustrates by hatches in tab 120 a beveled surface 129A that demarks an increase of thickness from the tab connection region 120A to tab body 128A. In certain embodiments, tabs 120 can be located on the long edge of the lid, as illustrated in FIG. 19, or the short edge of the lid.

Figure 11A:
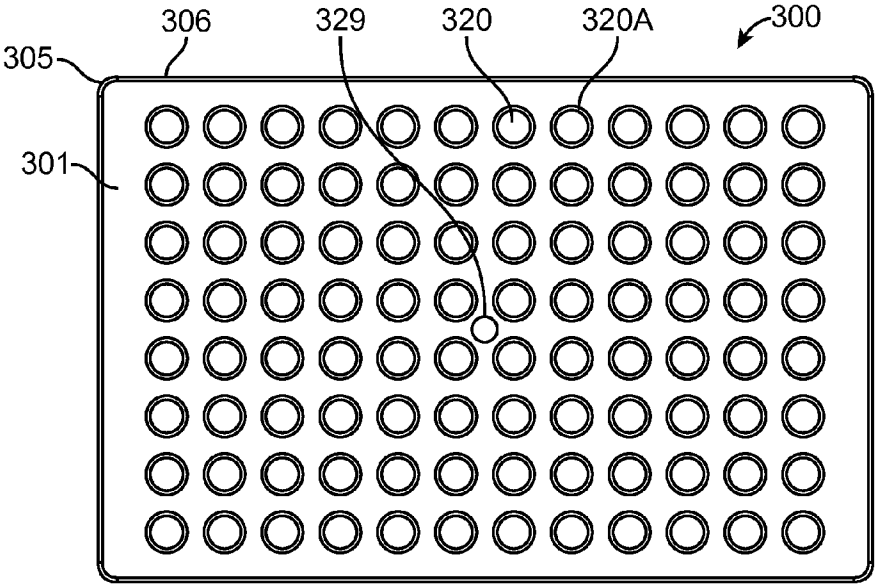
FIG. 11A shows a top view of a snap plate.
Figure 11B:
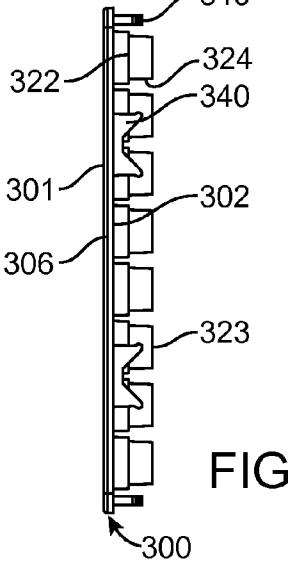
FIG. 11B shows a first side view of a snap plate.
Figure 11C:
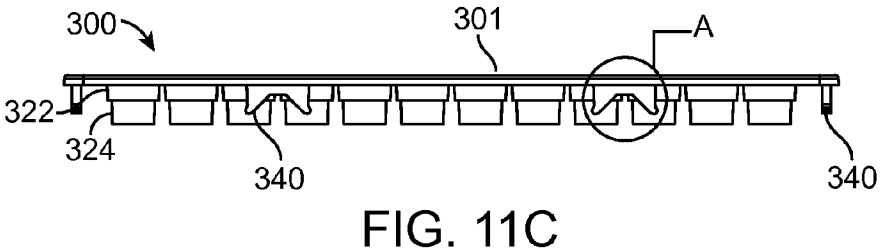
FIG. 11C shows a second side view of a snap plate.
Figure 11D:
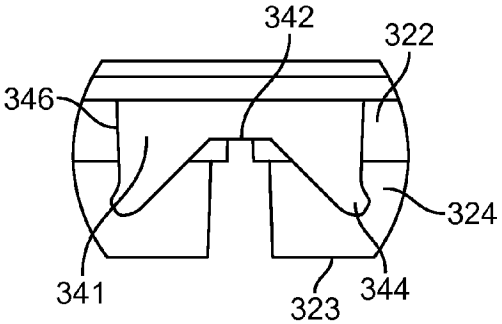
FIG. 11D shows an expanded detail view of a snap plate fastener.

FIG. 11A shows a top view of a snap plate, which illustrates an internal, annular step 320A and dimple 329. FIG. 11B shows a first side view of a snap plate, FIG. 11C shows a second side view of a snap plate and FIG. 11D shows an expanded detail view of a snap plate fastener. In certain embodiments, the surface of one or more tube members 324 includes an annular region of increased thickness.

Figure 12:
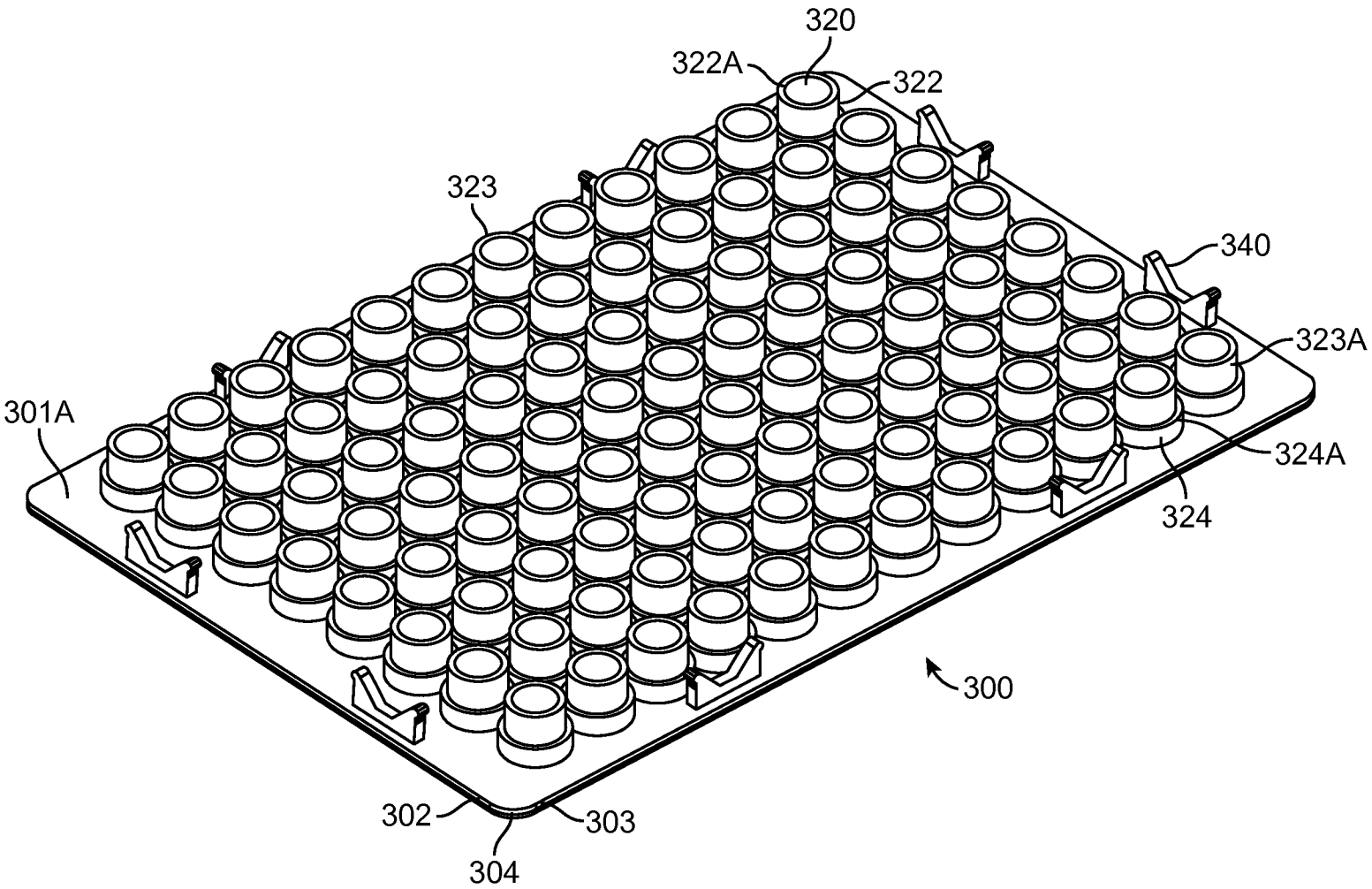
FIG. 12 shows a perspective view of the bottom of a plate.

FIG. 12 shows a perspective view of a bottom of a plate. Shown in FIG. 12 is bottom surface 301A opposite top surface 301. Also shown are tubes 323 that project from bottom surface 301. Tubes 323 are stepped, and have tube member 324 in connection with bottom surface 301A and concentric, co-axially arranged tube member 322 extending from tube member 324. At the junction of tube members 322 and 324 is step 324A, and the thickness 322A at the terminus of tube member 322 is shown, defining the perimeter and of bore 320. In some embodiments, tube member 322 can include an annular boss, which has an increased thickness, of any suitable profile (e.g., rounded, flat). Such a boss can be present on any suitable number of tubes (e.g., alternating tubes in the array) and can be located at about position 323A on a tube. A tube can be defined by any bore length to bore diameter ratio useful for retaining pipette tips, where bore length is the longitudinal axis distance from the top surface of the plate to the terminus of a tube and bore diameter is measured at the top surface of the plate. In some embodiments, the ratio is about 0.5 to about 3.0 (e.g., about 0.75, 1.0, 1.5, 2.0, 2.5). The position of step 324A, which defines the position of step 323, along the longitudinal axis distance from the bottom surface of the plate to the tube terminus, is suitable for retaining pipette tips. In certain embodiments, step 324A is located about one-fifth to about four-fifths of the distance from the bottom surface of the plate to the tube terminus. In certain embodiments, a outer surface of a tube is not stepped, and sometimes the outer surface of a tube is substantially smooth. A tube often includes a feature in the tube interior for retaining a pipette tip, including a step, bevel and the like.

Figure 20B:
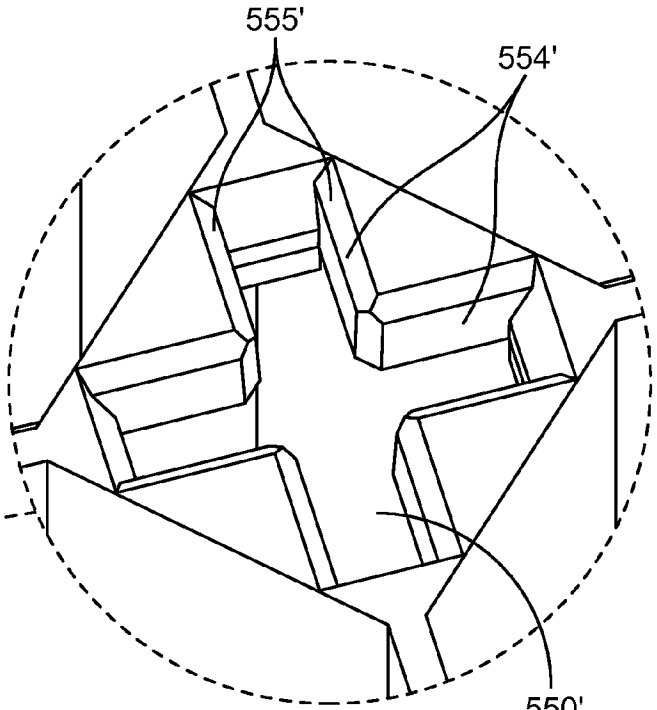
FIG. 20B shows an enlarged perspective view of a 4 slot (e.g., X-slot, cross-slot) fastener that forms a releasable interference fit with a 4 barb (e.g., 4 prong) projection fastener.
Figure 20A:
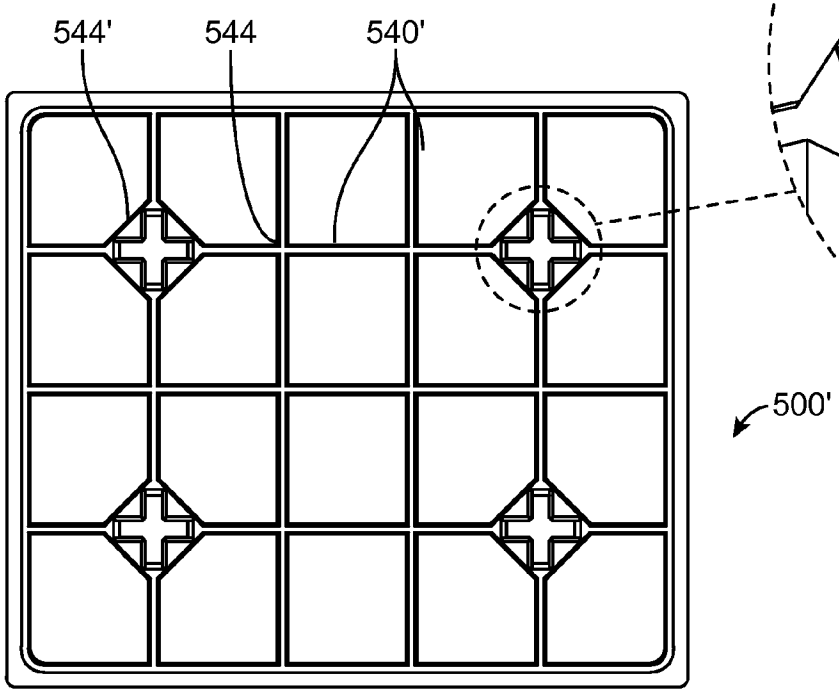
FIG. 20A shows a top view of a tray base configured to receive a 4 barb projection fastener.

Base embodiment 500' shown in FIG. 20A illustrates an alternative 4 slot fastener 550' configured to receive alternative 4 prong or barb projection fasteners 340' (see FIGS. 21 and 22) of plate 300'. Plate 300' can be configured to hold larger pipette tips (e.g., 1000 microliter or larger) and/or tubes of various sizes (e.g., microcentrifuge tubes, 5 ml tubes, 15 ml tubes, the like or combinations thereof). Slot fastener 550' is formed at the junction 544' of two internal walls or ribs 540' of base 500'. Slot fastener 550' substantially resembles two of slot fastener 550 joined together in an X or cross formation, as shown in FIG. 20B. Base fastener 550', also includes angled inner surface 555', and plate fastener contact surface 554'. Base embodiment 500' also is configured to engage a plate projection fastener and can include one or more angled surfaces (e.g., 1, 2, 3, 4, 5, 6, 7 or 8 angled surfaces), and the angle of each surface independently is selected from an angle of about 5 degrees to about 85 degrees with respect to a wall surface. In some embodiments, slot fastener positions are chosen to correspond to the internal wall junctions closest to the corners of base 500' external walls. The prime designation, "'", indicates the designated structure is substantially similar to a structure shown in another drawing bearing the same numerical identifier.

Figures 21A, 21B:
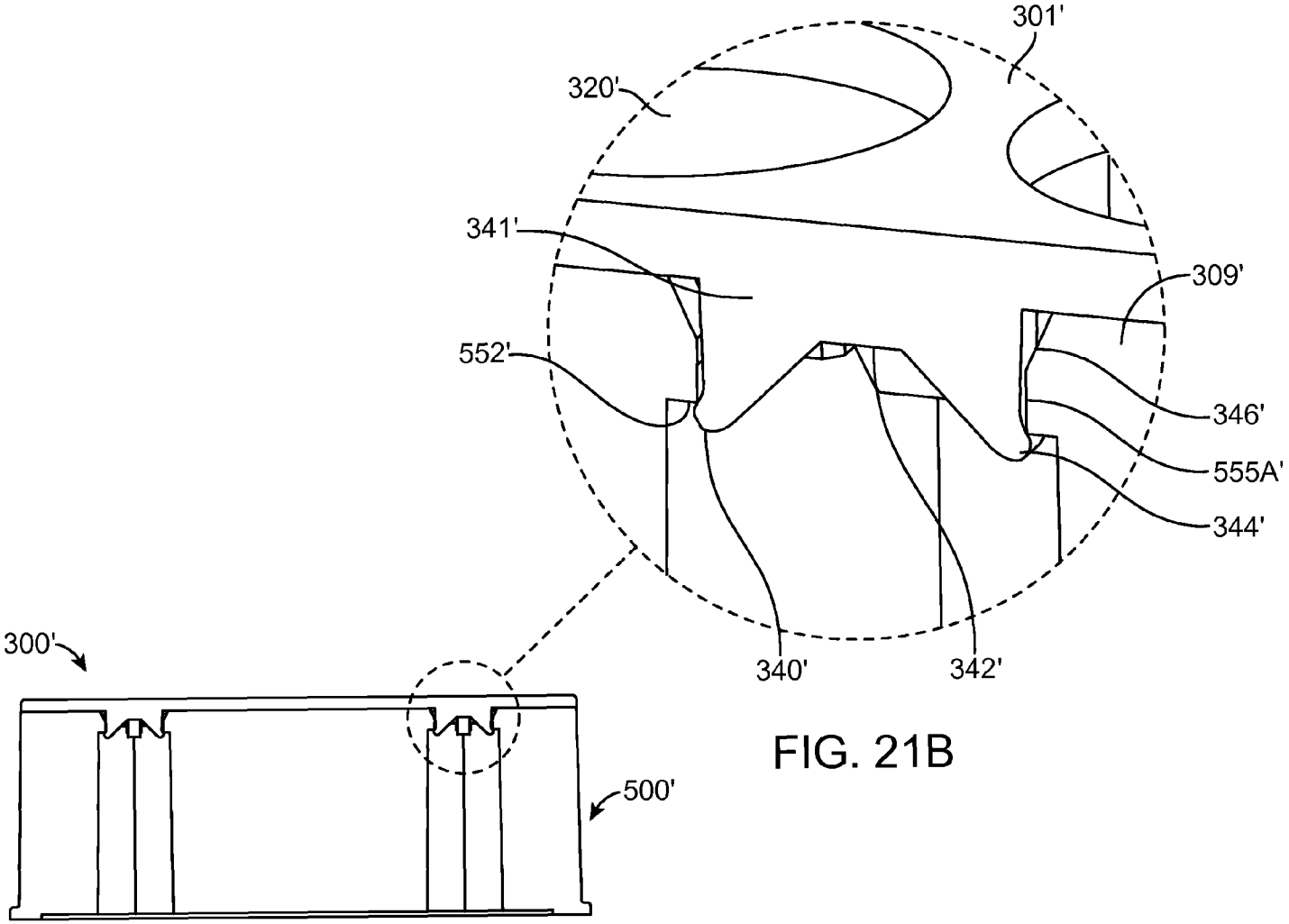
FIG. 21A shows a side cross-section view of a tray base configured to receive a 4 barb projection fastener.
FIG. 21B shows an enlarged perspective cross-section view of a 4 barb projection fastener engaged in a 4 slot fastener receiver. The cross section in 21A is taken along the midline of a wall configured as a projection fastener receiver.

Illustrated in FIG. 21A is a cross section side view of rack base 500' with an attached 4 prong fastener snap plate 300'. FIG. 21B is an enlarged perspective, detail view of the engagement of snap plate 300' and rack base 500'. Shown in FIG. 21B are fastener body 341', barb 344' and spacer 342' of plate fastener 340'. In certain embodiments, barb 344' deflects surface 554' of slot 550' away from its resting position as the plate fastener is engaged with the base fastener, and surface 554' relaxes back to its resting position on edge 346' of fastener 340' when the fastener 340' is fully engaged with slot 550' and barb 344' is positioned past the terminus 555A' of slot 550'.

Figures 22A, 22B, 22C:
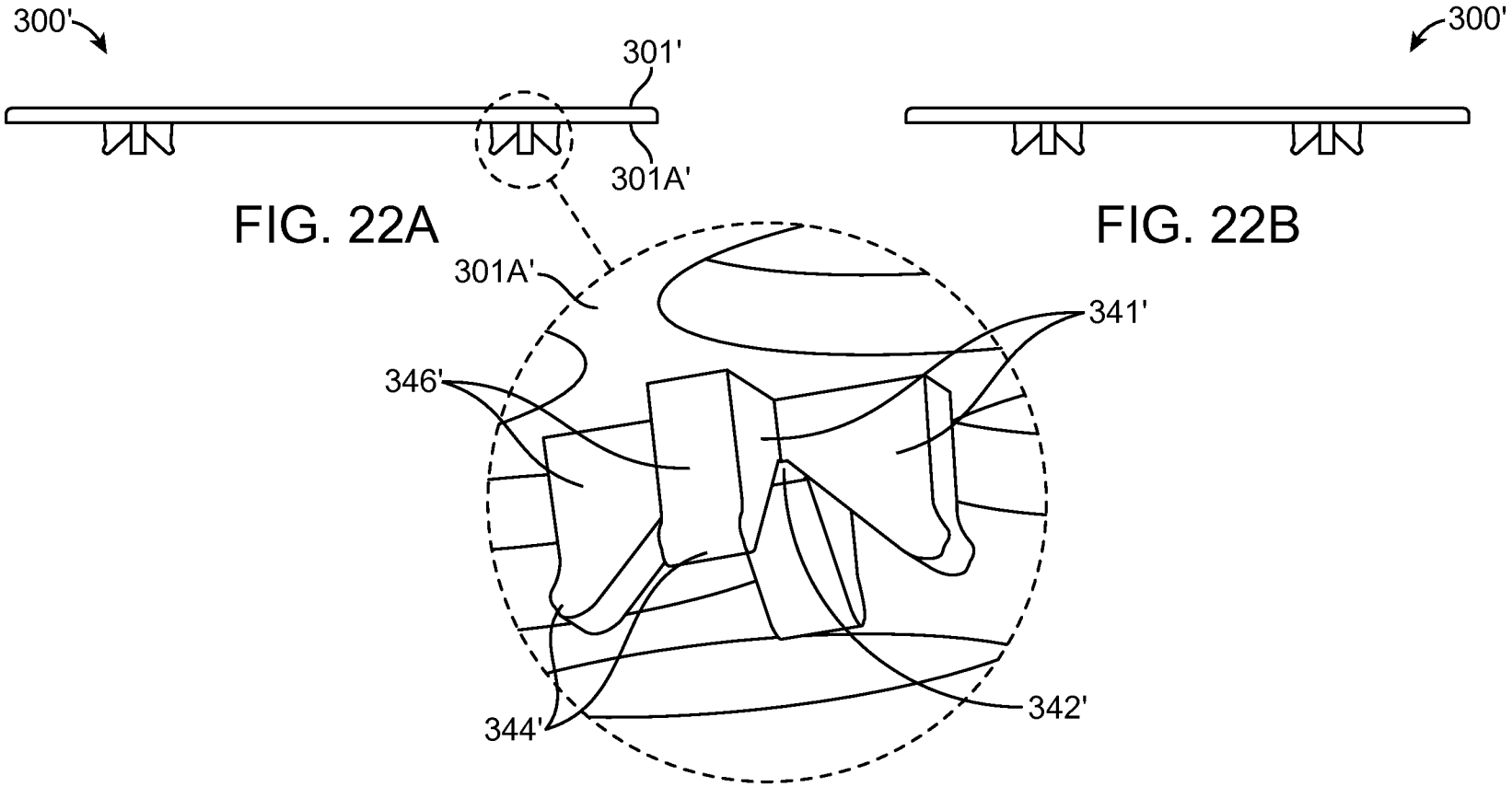
FIG. 22A shows a front/rear view of a snap plate configured with 4 prong projection fasteners.
FIG. 22B shows a side view of a snap plate configured with 4 prong projection fasteners.
FIG. 22C shows an enlarged perspective view of a 4 prong projection fastener depending from the bottom surface of a snap plate embodiment.

Front/rear and side views of 4 barb fastener 340' snap plate 300' are illustrated in FIGS. 22A and 22B. Also illustrated in FIGS. 22A and 22B are snap plate upper surface 301 and lower 301A, from which fastener 340' depends. FIG. 22A also shows a detail area that is enlarged in FIG. 22C. FIG. 22C shows an enlarged view of the various surfaces of 4 prong fastener 340'

Moldable Materials

Each tray component can be manufactured from a commercially suitable material. Tray components often are manufactured from one or more moldable materials, independently selected from those that include, without limitation, polypropylene (PP), polyethylene (PE), high-density polyethylene (HDPE), low-density polyethylene (LDPE), polyethylene teraphthalate (PET), polyvinyl chloride (PVC), polytetrafluoroethylene (PTFE), polystyrene (PS), high-density polystyrene, acrylnitrile butadiene styrene copolymers, crosslinked polysiloxanes, polyurethanes, (meth)acrylate-based polymers, cellulose and cellulose derivatives, polycarbonates, ABS, tetrafluoroethylene polymers, corresponding copolymers, plastics with higher flow and lower viscosity or a combination of two or more of the foregoing, and the like.

Non-limiting examples of plastics with higher flow and lower viscosity include, any suitable material having a hardness characterized by one or more of the following properties, in certain embodiments: a melt flow rate (230 degrees Celsius at 2.16 kg) of about 30 to about 75 grams per 10 minutes using an ASTM D 1238 test method; a tensile strength at yield of about 3900 to about 5000 pounds per square inch using an ASTM D 638 test method; a tensile elongation at yield of about 7 to about 14% using an ASTM D 638 test method; a flexural modulus at 1% sectant of about 110,000 to about 240,000 pounds per square inch using an ASTM D 790 test method; a notched Izod impact strength (23 degrees Celsius) of about 0.4 to about 4.0 foot pounds per inch using an ASTM D 256 test method; and/or a heat deflection temperature (at 0.455 MPa) of about 160 degrees to about 250 degrees Fahrenheit using an ASTM D 648 test method. A material used to construct the distal section and/or axial projections include moldable materials in some embodiments. Non-limiting examples of materials that can be used to manufacture the distal section and/or axial projections include polypropylene, polystyrene, polyethylene, polycarbonate, and the like, and mixtures thereof. In certain embodiments, a tray component described herein is not manufactured from an elastomer, with certain exceptions for antistatic components described hereafter should they be included.

Anti-Microbial Materials

A tray component may include one or more antimicrobial materials. An antimicrobial material may be coated on a surface (e.g., inner and/or outer surface) or impregnated in a moldable material, in some embodiments. One or more portions or sections, or all portions and sections, of a tray component may include one or more antimicrobial materials. In some embodiments anti-microbial agents or substances may be added to the moldable plastic during the manufacture process. In some embodiments, the anti-microbial agent or substance can be an anti-microbial metal. The addition of anti-microbial agents may be useful in (i) decreasing the amount of microbes present in or on a device, (ii) decreasing the probability that microbes reside in or on a device, and/or (iii) decreasing the probability that microbes form a biofilm in or on a device, for example. Antimicrobial materials include, without limitation, metals, halogenated hydrocarbons, quaternary salts and sulfur compounds.

Non-limiting examples of metals with anti-microbial properties are silver, gold, platinum, palladium, copper, iridium (i.e. the noble metals), tin, antimony, bismuth, zinc cadmium, chromium, and thallium. The afore-mentioned metal ions are believed to exert their effects by disrupting respiration and electron transport systems upon absorption into bacterial or fungal cells. A commercially accessible form of silver that can be utilized in devices described herein is SMARTSILVER NovaResin. SMARTSILVER NovaResin is a brand of antimicrobial master batch additives designed for use in a wide range of polymer application. Billions of silver nanoparticles can easily be impregnated into PET, PP, PE and nylon using standard extrusion or injection molding equipment. SMARTSILVER NovaResin additives may be delivered as concentrated silver-containing master batch pellets to facilitate handling and processing. NovaResin is designed to provide optimum productivity in a wide range of processes, including fiber extrusion, injection molding, film extrusion and foaming.

Further non-limiting examples of anti-microbial substances or agents include, without limitation, inorganic particles such as barium sulfate, calcium sulfate, strontium sulfate, titanium oxide, aluminum oxide, silicon oxide, zeolites, mica, talcum, and kaolin. Anti-microbial substances also include halogenated hydrocarbons, quaternary salts and sulfur active compounds.

Halogenated hydrocarbons, include, without limitation, halogenated derivatives of salicylanilides (e.g., 5-bromo-salicylanilide; 4',5-dibromo-salicylanilide; 3,4',5-tribromo-salicylanilide; 6-chloro-salicylanilide; 4'S-dichloro-salicylanilide; 3,4'5-trichloro-salicylanilide; 4',5-diiodo-salicylanilide; 3,4',5-triiodo-salicylanilide; 5-chloro-3'-trifluoromethyl-salicylanilide; 5-chloro-2'-trifluoromethyl-salicylanilide; 3,5-dibromo-3'-trifluoromethyl-salicylanilide; 3-chloro-4-bromo-4'-trifluoromethyl-salicylanilide; 2',5-dichloro-3-phenyl-salicylanilide; 3',5-dichloro-4'-methyl-3-phenyl-salicylanilide; 3',5-dichloro-4'-phenyl-3-phenyl-salicylanilide; 3,3',5-trichloro-6'-(p-chlorophenoxy)-salicylanilide; 3',5-dichloro-5'-(p-bromophenoxy)-salicylanilide; 3,5-dichloro-6'-phenoxy-salicylanilide; 3,5-dichloro-6'-(o-chlorophenoxy)-salicylanilide; 5-chloro-6'-(o-chlorophenoxy)-salicylanilide; 5-chloro-6'-beta-naphthyloxy-salicylanilide; 5-chloro-6'-alpha-na phthyloxy-salicylanilide; 3,3',4-trichloro-5,6'-beta-naphthyloxy-salicylalide and the like).

Halogenated hydrocarbons also can include, without limitation, carbanilides (e.g., 3,4,4'-trichloro-carbanilide (TRICLOCARBAN); 3,3',4-trichloro derivatives; 3-trifluoromethyl-4,4'-dichlorocarbanilide and the like). Halogenated hydrocarbons include also, without limitation, bisphenols (e.g., 2,2'-methylenebis(4-chlorophenol); 2,2'-methylenebis (4,5-dichlorophenol); 2,2'-methylenebis(3,4,6-trichlorophenol); 2,2'-thiobis(4,6-dichlorophenol); 2,2'-diketobis(4-bromophenol); 2,2'-methylenebis(4-chloro-6-isopropylphenol); 2,2'-isopropylidenebis(6-sec-butyl-4-chlorophenol) and the like).

Also included within hydrogenated hydrocarbons are halogenated mono- and poly-alkyl and aralkyl phenols (e.g., methyl-p-chlorophenol; ethyl-p-chlorophenol; n-propyl-p-chlorophenol; n-butyl-p-chlorophenol; n-amyl-p-chlorophenol; sec-amyl-p-chlorophenol; n-hexyl-p-chlorophenol; cyclohexyl-p-chlorophenol; n-heptyl-p-chlorophenol; n-octyl-p-chlorophenol; o-chlorophenol; methyl-o-chlorophenol; ethyl-o-chlorophenol; n-propyl-o-chlorophenol; n-butyl-o-chlorophenol; n-amyl-o-chlorophenol; tert-amyl-o-chlorophenol; n-hexyl-o-chlorophenol; n-heptyl-o-chlorophenol; p-chlorophenol; o-benzyl-p-chlorophenol; o-benzyl-m-methyl-p-chlorophenol; o-benzyl-m, m-dimethyl-p-chlorophenol; o-phenylethyl-p-chlorophenol; o-phenylethyl-m-methyl-p-chlorophenol; 3-methyl-p-chlorophenol; 3,5-dimethyl-p-chlorophenol; 6-ethyl-3-methyl-p-chlorophenol; 6-n-propyl-3-methyl-p-chlorophenol; 6-isopropyl-3-methyl-p-chlorophenol; 2-ethyl-3,5-dimethyl-p-chlorophenol; 6-sec butyl-3-methyl-p-chlorophenol; 6-diethylmethyl-3-methyl-p-chlorophenol; 6-iso-propyl-2-ethyl-3-methyl-p-chlorophenol; 2-sec amyl-3,5-dimethyl-p-chlorophenol; 2-diethylmethyl-3,5-dimethyl-p-chlorophenol; 6-sec octyl-3-methyl-p-chlorophenol; p-bromophenol; methyl-p-brdmophenol; ethyl-p-bromophenol; n-propyl-p-bromophenol; n-butyl-p-bromophenol; n-amyl-p-bromophenol; sec-amyl-p-bromophenol; n-hexyl-p-bromophenol; cyclohexyl-p-bromophenol; o-bromophenol; tert-amyl-o-bromophenol; n-hexyl-o-bromophenol; n-propyl-m, m-dimethyl-o-bromophenol; 2-phenyl phenol; 4-chloro-2-methyl phenol; 4-chloro-3-methyl phenol; 4-chloro-3,5-dimethyl phenol; 2,4-dichloro-3,5-dimethylphenol; 3,4,5,6-terabromo-2-methylphenol; 5-methyl-2-pentylphenol; 4-isopropyl-3-methylphenol; 5-chloro-2-hydroxydiphenylemethane).

Halogenated hydrocarbons also include, without limitation, chlorinated phenols (e.g., parachlorometaxylenol, p-chloro-o-benzylphenol and dichlorophenol); cresols (e.g., p-chloro-m-cresol), pyrocatechol; p-chlorothymol; hexachlorophene; tetrachlorophene; dichlorophene; 2,3-dihydroxy-5,5'-dichlorophenyl sulfide; 2,2'-dihydroxy-3,3',5,5'-tetrachlorodiphenyl sulfide; 2,2'-dihydroxy-3,3',5,5',6,6'-hexachlorodiphenyl sulfide and 3,3'-dibromo-5,5'-dichloro-2,2'-dihydroxydiphenylamine). Halogenated hydrocarbons also may include, without limitation, resorcinol derivatives (e.g., p-chlorobenzyl-resorcinol; 5-chloro-2,4-dihydroxy-diphenyl methane; 4'-chloro-2,4-dihydroxydiphenyl methane; 5-bromo-2,4-dihydroxydiphenyl methane; 4'-bromo-2, 4-dihydroxydiphenyl methane), diphenyl ethers, anilides of thiophene carboxylic acids, chlorhexidines, and the like.

Quaternary salts include, without limitation, ammonium compounds that include alkyl ammonium, pyridinum, and isoquinolinium salts (e.g., 2,2'-methylenebis(4-chlorophenol); 2,2'-methylenebis(4,5-dichlorophenol); 2,2'-methylenebis(3,4,6-trichlorophenol); 2,2'-thiobis(4,6-dichlorophenol); 2,2'-diketobis(4-bromophenol); 2,2'-methylenebis(4-chloro-6-isopropylphenol); 2,2'-isopropylidenebis(6-sec-butyl-4-chlorophenol); cetyl pyridinium chloride; diisobutylphenoxyethoxyethyldimethylbenzyl ammonium chloride; N-methyl-N-(2-hydroxyethyl)-N-(2-hydroxydodecyl)-N-benzyl ammonium chloride; cetyl trimethylammonium bromide; stearyl trimethylammonium bromide; ° leyl dimethylethylammonium bromide; lauryidimethylchlorethoxyethylammonium chloride; lauryidimethylbenzyl-ammonium chloride; alkyl (Cg-Cig) dimethyl (3,4-dichlorobenzyl)-ammonium chloride; lauryl pyridinium bromide; lauryl iso-quinolinium bromide; N (lauroyloxyethylamino-formylmethyl) pyridinium chloride, and the like).

Sulfur active compounds include, without limitation, thiuram sulfides and dithiocarbamates, for example (e.g., disodium ethylene bis-dithiocarbamate (Nabam); diammonium ethylene bis-dithiocarbamate (amabam); Zn ethylene bis-dithiocarbamate (ziram); Fe ethylene bis-dithiocarbamate (ferbam); Mn ethylene bis-dithiocarbamate (manzate); tetramethyl thiuram disulfide; tetrabenzyl thiuram disulfide; tetraethyl thiuram disulfide; tetramethyl thiuram sulfide, and the like).

In certain embodiments, an antimicrobial material comprises one or more of 4',5-dibromosalicylanilide; 3,4',5-tribromosalicylanilide; 3,4',5-trichlorosalicylanilide; 3,4,4'-trichlorocarbanilide; 3-trifluoromethyl-4,4'-dichlorocarbanilide; 2,2'-methylenebis(3,4,6-trichlorophenol); 2,4,4'-trichloro-2'-hydroxydiphenyl ether; Tyrothricin; N-methyl-N-(2-hydroxyethyl-N-(2-hydroxydodecyl)-N-benzylammonium chloride; cetyl pyridinium chloride; 2,3',5-tribromosalicylanilide; chlorohexidine digluconate; chlorohexidine diacetate; 4',5-dibromosalicylanilide; 3,4,4'-trichlorocarbanilide; 2,4,4'-trichloro-2-hydroxydiphenyl ether (TRICLOSAN; 5-chloro-2-(2,4-dichlorophenoxy) phenol); 2,2'-dihydroxy-5,5'-dibromo-diphenyl ether) and the like.

Methods for manufacturing anti-microbial containing plastic devices are described in International Patent Application No. PCT/US2009/047541, filed on Jun. 16, 2009, published as published patent application no. WO 2010/008737 on Jan. 21, 2010, and entitled ANTIMICROBIAL FLUID HANDLING DEVICES AND METHODS OF MANUFACTURE, having attorney docket number PEL-1004-PC, the entirety of which is hereby incorporated herein by reference.

Degradable Materials

One or more pipette tip tray components described herein may be constructed from a degradable material. Any suitable degradable material may be utilized, including without limitation from a natural polymer, a bacterial produced cellulose, and/or chemically synthesized polymeric material.

Non-limiting examples of a natural polymer include starch/synthetic biodegradable plastic, cellulose acetate, chitosan/cellulose/starch and denatured starch. Non-starch biodegradable components may include chitin, casein, sodium (or zinc, calcium, magnesium, potassium) phosphate and metal salt of hydrogen phosphate or dihydrogen phosphate, amide derivatives of erucamide and oleamide and the like, for example. Non-limiting examples of bacterial produced cellulose include homopolymers, polymer blends, aliphatic polyesters, chemosynthetic compounds and the like. Non-limiting examples of chemically synthesized polymeric material include aliphatic polyester, an aliphatic-aromatic polyester and a sulfonated aliphatic-aromatic polyester.

In some embodiments, a tray component is manufactured from a moldable material that is photodegradable and further includes a photosensitizer. Non-limiting examples of photsensitizers include aliphatic and/or aromatic ketones, including without limitation acetophenone, acetoin, I'-acetonaphthone, 2'-acetonaphtone, anisoin, anthrone, bianthrone, benzil, benzoin, benzoin methyl ether, benzoin isopropyl ether, 1-decalone, 2-decalone, benzophenone, p-chlorobenzophenone, dibenzalacetone, benzoylacetone, benzylacetone, deoxybenzoin, 2,4-dimethylbenzophenone, 2,5-dimethylbenzophenone, 3,4-dimethylbenzophenone, 4-benzoylbiphenyl, butyrophenone, 9-fluorenone, 4,4-bis-(dimethylamino)-benzophenone, 4-dimethylaminobenzophenone, dibenzyl ketone, 4-methylbenzophenone, propiophenone, benzanthrone, 1-tetralone, 2-tetralone, valerophenone, 4-nitrobenzophenone, di-n-hexyl ketone, isophorone, xanthone and the like. Aromatic ketones may be used such as benzophenone, benzoin, anthrone, deoxyanisoin and quinones (e.g., anthraquinone, 1-aminoanthraquinone, 2-aminoanthraquinone, 1-chloroanthraquinone, 2-chloroanthraquinone, 1-methylanthraquinone, 2-methylanthraquinone, 1-nitroanthraquinone, 2-phenylanthraquinone, 1,2-naphthoquinone, 1,4-naphthoquinone, 2-methyl-1,4-naphthoquinone, 1,2-benzanthraquinone, 2,3-benzanthraquinone, phenanthrenequinone, 1-methoxyanthraquinone, 1,5-dichloroanthraquinone, and 2,2'-dimethyl-1,1'-dianthraquinone, and anthraquinone dyes. Quinones that may be used are 2-methylanthraquinone, 2-chloroanthraquinone, 2-ethylanthraquinone and the like). A photodegradable plastic may include iron, zinc, cerium cobalt, chromium, copper, vanadium and/or manganese compounds in certain embodiments.

In some embodiments, a tray component comprises a polyhydroxy-containing carboxylate, such as polyethylene glycol stearate, sorbitol palmitate, adduct of sorbitol anhydride laurate with ethylene oxide and the like; epoxidized soybean oil, oleic acid, stearic acid, and epoxy acetyl castor oil or combinations thereof. A tray component may include maleic anhydride, methacrylic anhydride or maleimide in some embodiments, and in certain embodiments, a tray component may comprise a polymer attacking agent such as a microorganism or an enzyme. In some embodiments, a tray component may include a coating layer, which prevents passage of gas or permeation of water, on one or more surfaces that come into contact with a liquid. A tray component that includes a coating layer also may have silicon, oxygen, carbon, hydrogen, an edible oil, a drying oil, melamine, a phenolic resin, a polyester resin, an epoxy resin, a terpene resin, a urea-formaldehyde rein, a styrene polymer, polyvinyl chloride, polyvinyl alcohol, polyvinyl acetate, a polyacrylate, a polyamide, hydroxypropylmethylcellulose, methocel, polyethylene glycol, an acrylic, an acrylic copolymer, polyurethane, polylactic acid, a polyhydroxybutyrate-hydroxyvalerate copolymer, a starch, soybean protein, a wax, and/or mixtures thereof.

A tray component can be manufactured from any type of environmentally friendly, earth friendly, biologically friendly, natural, organic, carbon based, basic, fundamental, elemental material. Biologically or environmentally friendly materials can comprise any materials that are considered to inflict minimal or no harm on biological organisms or the environment. Such materials can aid in degradation and/or recycling of a tray or component thereof. Such materials can have non-toxic properties, aid in producing less pollutants, promote an organic environment, and further support living organisms. In some embodiments a tray component can be made from recycled or organic materials and/or in combination with degradable materials. In certain embodiments, bio-PET can be produced from a wide variety of different sources. Bio-PET can be produced from any of type of plant such as algae, for example. Other biologically or environmentally friendly PET materials may be produced from other sources such as animals, inert substances, organic materials or man-made materials, for example.

Degradable materials and methods of use are described in International Patent Application No. PCT/US2009/063762, filed on Nov. 9, 2009, and entitled DEGRADABLE FLUID HANDLING DEVICES, the entirety of which is hereby incorporated herein by reference.

Anti-static Materials and Components

Anti-static materials and conditions sometimes are applied to a pipette tray and/or component thereof. In certain embodiments an anti-static agent can be incorporated into a moldable plastic during the manufacture process of a tray component described herein. A tray component may comprise any type of electrically conductive material, such as a conductive metal for example. Non-limiting examples of electrically conductive metals include platinum (Pt), palladium (Pd), copper (Cu), nickel (Ni), silver (Ag) and gold (Au). A conductive metal may be in any form in or on a tray component, for example, such as metal flakes, metal powder, metal strands or coating of metal.

An electrically conductive material, or portion thereof, may be any material that contains movable electric charges, such as carbon for example. In some embodiments, a tray component comprises about 5% to about 40% or more carbon by weight (e.g., 7-10%, 9-12%, 11-14%, 13-16%, 15-18%, 17-20%, 19-22%, 21-24%, 23-26%, 25-28%, 27-30%, 29-32%, 32-34%, 33-36%, or 35-38% carbon by weight).

A tray component that contacts a pipette tip can be a candidate for receiving one or more conductive materials, in some embodiments. Thus, in some embodiments, a plate sometimes is manufactured from a material that comprises one or more conductive materials. A lid in certain embodiments comprises a conductive material. A tray component also may include a conductive element, such as a conductive tab. A conductive element can be affixed to a part of a tray component, and sometimes is in effective communication with another tray component. For example, a conductive element, such as a conductive tab, may traverse a slot or groove in a lid, plate, base or combination thereof, and be in communication with the tray exterior and tray interior. Such a configuration can transmit electrostatic charge from pipette tips in the tray interior to the tray exterior from which the charge can be discharged.

Pipette tips are substantially immobilized in certain anti-static tray component embodiments, as minimizing pipette tip movement may reduce the amount of static charge generated in or on a pipette tip. Pipette tips can be substantially immobilized by restricting pipette tip movement in a plate, for example. Elements in a plate can restrict movement, such as longer bore length (e.g., longer tube length), smaller bore diameter and combinations thereof, for example. Elements in a lid also can restrict movement, such as placing the inner surface of the lid top in effective contact with tops of pipette tips, for example. The inner surface of the lid top is in direct contact with tops of the pipette tips in some embodiments, and a member in connection with the lid that exerts pressure on the pipette tip tops sometimes is present in a tray. In the latter embodiments, the member in connection with the lid sometimes comprises a material that can deform against the pipette tip tops, such as an elastomeric material, for example. In some embodiments a member in connection with the lid sometimes comprises a conductive material. A member in connection with the lid sometimes is a pillow structure, that includes a casing containing a conductive material,l within which is a material that can deform. A member in connection with the lid sometimes is in effective connection with a conductive member in communication with the tray exterior (e.g., a tab that traverses the lid, plate and/or base).

Methods for manufacturing components and trays comprising an anti-static member are described in International Patent Application No. PCT/US2010/021838, filed on Jan. 22, 2010, and entitled "ANTI-STATIC PIPETTE TITRAYS", having attorney docket number PEL-1009-PC, which is hereby incorporated by reference herein, in its entirety.

Methods for Manufacturing Tray Components

Tray components may be manufactured by any suitable process. Examples of manufacturing processes include thermoforming, vacuum forming, pressure forming, plug-assist forming, reverse-draw thermoforming, matched die forming, extrusion, casting and injection molding.

Injection molding is a manufacturing process for producing objects (e.g., tray components, for example) from thermoplastic (e.g., nylon, polypropylene, polyethylene, polystyrene and the like, for example) and thermosetting plastic (e.g., epoxy and phenolics, for example) materials. The plastic material of choice often is fed into a heated barrel, mixed, and forced into a mold cavity where it cools and hardens to the configuration of the mold cavity. The melted material sometimes is forced or injected into the mold cavity, through openings (e.g., a sprue), under pressure. A pressure injection method ensures the complete filling of the mold with the melted plastic. After the mold cools, the mold portions are separated, and the molded object is ejected. In some embodiments, additional additives can be included in the plastic or mold to give the final product additional properties (e.g., anti-microbial, or anti-static properties, for example). In some embodiments, tray components described herein are injection molded as a unitary construct.

A mold often is configured to hold the molten plastic in the correct geometry to yield the desired product upon cooling of the plastic. Injection molds sometimes are made of two or more parts.

Molds typically are designed so that the molded part reliably remains on the ejector side of the mold after the mold opens, after cooling. The part can then fall freely away from the mold when ejected from ejector side of the mold. In some embodiments, an ejector sleeve pushes the tray component from the ejector side of the mold.

Also provided herein is a mold for manufacturing a device by an injection mold process, which comprises a body that forms an exterior portion of the device and a member that forms an inner surface of the device.

Examples of Pipette Tip Tray Embodiments

Provided hereafter are certain non-limiting examples of embodiments of the technology.

A1. A pipette tip tray, comprising:

a top that includes an array of bores, each bore configured to receive a partially-inserted pipette tip;

sides, one or more sides including a step and a first fastener in association with the step; and a lid that includes a second fastener, wherein:

the first fastener and the second fastener independently are chosen from a fastener comprising a slot and a fastener comprising a tab, the tab is in flexible association with the lid or side, and the first fastener and the second fastener are reversibly engaged.

A2. The pipette tip tray of embodiment A1, wherein the side comprises at least one slot.

A3. The pipette tip tray of embodiment A1 or A2, wherein the lid comprises at least one tab.

A4. The pipette tip tray of embodiment A3, wherein the tab is in flexible association with the edge of the lid.

A5. The pipette tip tray of embodiment A4, wherein the lid comprises a top and sides, and an edge of one of the sides is in association with the tab.

A6. The pipette tip tray of any one of embodiments A1 to A5, wherein the side comprises two slots and the lid comprises two tabs.

A7. The pipette tip tray of any one of embodiments A1 to A5, wherein the lid comprises a slot and a tab and the side includes a slot and a tab.

A8. The pipette tip tray of any one of embodiments A1 to A7, wherein the step defines a lip.

A9. The pipette tip tray of embodiment A8, wherein the lip comprises the first fastener.

A10. The pipette tip tray of embodiment A9, wherein the first fastener is a slot.

A11. The pipette tip tray of embodiment A10, wherein the lip comprises two or more slots.

A12. The pipette tip tray of any one of embodiments A1 to A11, whereby engagement of the first fastener with the second fastener conceals the tab.

A13. The pipette tip tray of any one of embodiments A1 to A12, wherein a side including the step and a first fastener in association with the step is located on a long side of the tray.

A14. The pipette tip tray of any one of embodiments A1 to A12, wherein a side including the step and a first fastener in association with the step is located on a short side of the tray.

B1. A pipette tip tray, comprising:

a top that includes an array of bores, each bore configured to receive a partially-inserted pipette tip; and sides, each side including an edge in association with a surface of the top, wherein: the edge of each of two or more of the sides includes a plurality of first fasteners, the surface of the top includes a plurality of second fasteners, and the first fasteners are releasably secured to the second fasteners.

B2. The pipette tray of embodiment B1, wherein the first fasteners and the second fasteners independently are selected from orifices and projections.

B3. The pipette tip tray of embodiment B2, wherein the projections snap-fit with the orifices.

B4. The pipette tip tray of embodiment B2 or B3, wherein the orifices comprise a slot.

B5. The pipette tip tray of any one of embodiments B2 to B4, wherein the orifices comprise walls and wall termini, and the projections comprise barbs configured to engage contact points on the walls, wall termini or walls and wall termini of the orifices.

B5.1 The pipette tip tray of any one of embodiments B2 to C5, wherein the orifices comprise the junction of two internal walls, and the projections comprise barbs configured to engage contact points in the walls, wall termini or walls and wall termini of the orifices.

B6. The pipette tip tray of embodiment B5 and B5.1, wherein each projection comprises two barbs.

B6.1 The pipette tip tray of embodiment B5 and B5.1, wherein each projection comprises 3 or more barbs.

B6.2 The pipette tip tray of embodiment B5 and B5.1, wherein each projection comprises 4 barbs.

B7. The pipette tip tray of any one of embodiments B1 to B6.2, wherein the top is in reversible association with the sides.

B8. The pipette tip tray of any one of embodiments B1 to B7, wherein the top is not irreversibly fixed to one or more of the sides.

B9. The pipette tip tray of embodiment B8, wherein the top is not welded to one or more of the sides.

B10. The pipette tip tray of any one of embodiments B2 to B9, wherein the surface of the top comprises the projections.

B11. The pipette tip tray of any one of embodiments B2 to B9, wherein the edge of each of the two or more sides comprises the orifices.

B11.1 The pipette tip tray of any one of embodiments B2 to B9, wherein the junction of two or more internal walls comprise the orifices.

B12. The pipette tip tray of any one of embodiments B2 to B9, wherein the surface of the top comprises projections and orifices and the edge of each of the two or more sides comprise orifices and projections.

C1. A pipette tip tray, comprising:

a top that includes an array of bores, each bore configured to receive a partially-inserted pipette tip;

sides, one or more sides including a step and a first fastener in association with the step; and a lid that includes a second fastener, wherein:

the first fastener and the second fastener independently are selected from a fastener comprising a slot and a fastener comprising a tab, the tab is in flexible association with the lid or side, the first fastener and the second fastener are reversibly engaged, the edge of each of two or more of the sides includes a plurality of third fasteners, the surface of the top includes a plurality of fourth fasteners, and the third fasteners are releasably secured to the fourth fasteners.

C2. The pipette tray of embodiment C1, wherein the third fasteners and the fourth fasteners independently are selected from orifices and projections.

C3. The pipette tip tray of embodiment C2, wherein the projections snap-fit with the orifices.

C4. The pipette tip tray of embodiment C2 or C3, wherein the orifices comprise a slot.

C5. The pipette tip tray of any one of embodiments C2 to C4, wherein the orifices comprise walls and wall termini, and the projections comprise barbs configured to engage contact points in the walls, wall termini or walls and wall termini of the orifices.

C5.1 The pipette tip tray of any one of embodiments C2 to C5, wherein the orifices comprise the junction of two internal walls, and the projections comprise barbs configured to engage contact points in the walls, wall termini or walls and wall termini of the orifices.

C6. The pipette tip tray of embodiment C5 and C5.1, wherein each projection comprises two barbs.

C6.1 The pipette tip tray of embodiment C5 and C5.1, wherein each projection comprises 3 or more barbs.

C6.2. The pipette tip tray of embodiment C5 and C5.1, wherein each projection comprises 4 barbs.

C7. The pipette tip tray of any one of embodiments C1 to C6.2, wherein the top is in reversible association with the sides.

C8. The pipette tip tray of any one of embodiments C1 to C7, wherein the top is not irreversibly fixed to one or more of the sides.

C9. The pipette tip tray of embodiment C8, wherein the top is not welded to one or more of the sides.

C10. The pipette tip tray of any one of embodiments C2 to C9, wherein the surface of the top comprises the projections.

C11. The pipette tip tray of any one of embodiments C2 to C9, wherein the edge of each of the two or more sides comprises the orifices.

C11.1 The pipette tip tray of any one of embodiments C2 to C9, wherein the junction of two or more internal walls comprises the orifices.

C12. The pipette tip tray of any one of embodiments C2 to C9, wherein the surface of the top comprises projections and orifices and the edge of each of the two or more sides comprise orifices and projections.

C13. The pipette tip tray of any one of embodiments C1 to C12, wherein the side comprises at least one slot.

C14. The pipette tip tray of any one of embodiments C1 to C13, wherein the lid comprises at least one tab.

C15. The pipette tip tray of embodiment C14, wherein the tab is in flexible association with the edge of the lid.

C16. The pipette tip tray of embodiment C15, wherein the lid comprises a top and sides, and an edge of one of the sides is in association with the tab.

C17. The pipette tip tray of any one of embodiments C1 to C16, wherein the side comprises two slots and the lid comprises two tabs.

C18. The pipette tip tray of any one of embodiments C1 to C17, wherein the lid comprises a slot and a tab and the side includes a slot and a tab.

C19. The pipette tip tray of any one of embodiments C1 to A18, wherein the step defines a lip.

C20. The pipette tip tray of embodiment C19, wherein the lip comprises the first fastener.

C21. The pipette tip tray of embodiment C20, wherein the first fastener is a slot.

C22. The pipette tip tray of embodiment C21, wherein the lip comprises two or more slots.

C23. The pipette tip tray of any one of embodiments C1 to A22, whereby engagement of the first fastener with the second fastener conceals the tab.

C24. The pipette tip tray of any one of embodiments C1 to C23, wherein a side including the step and a first fastener in association with the step is located on a long side of the tray.

C25. The pipette tip tray of any one of embodiments C1 to C23, wherein a side including the step and a first fastener in association with the step is located on a short side of the tray.

D1. The pipette tip tray of any one of embodiments A1 to A12, B1 to B12 and C1 to C23, comprising pipette tips partially inserted in the bores, or subset thereof.

D2. The pipette tip tray of any one of embodiments A1 to A12, B1 to B12 and C1 to C23, wherein the surface of the top comprises a tube coaxially disposed with each bore.

D3. The pipette tip tray of embodiment D2, wherein the tube includes an interior surface that comprises a step configured to provide a seating surface for a seating feature of pipette tips partially inserted in the bore.

E1. A method, comprising:

providing a pipette tip tray of any one of embodiments A1 to A14, C1 to C25 and D1 to D3, and disengaging the first fastener from the second fastener, thereby disengaging the lid from the side comprising the first fastener.

E2. A method, comprising:

providing a pipette tip tray of any one of embodiments B1 to B12, and disengaging the first fasteners from the second fasteners, thereby disengaging the top from the sides.

E3. A method, comprising:

providing a pipette tip tray of any one of embodiments C1 to C25, and disengaging the third fasteners from the fourth fasteners, thereby disengaging the top from the sides.

F1. A pipette tray, comprising:

a lid that includes an edge and a fastener component in association with the edge of the lid, and a rack in effective connection with the lid, which rack comprises a base that includes sides, a fastener component in association with the rack, and a top that contains an array of bores configured to receive partially inserted pipette tips; wherein:

the fastener component in association with the edge of the lid is releasably secured to the fastener component in association with the rack, the fastener component in association with the edge of the lid is concealed within the rack, and the lid can pivot with respect to the rack around the fastener component in association with the edge of the lid.

F2. The pipette tip tray of embodiment F1, wherein the fastener component in association with the rack is in association with a side of the base.

F3. The pipette tip tray of embodiment F1 or F2, wherein the fastener component in association with the edge of the lid is a projection fastener and the fastener component in association with the rack is an orifice fastener.

F4. The pipette tip tray of embodiment F3, wherein the projection fastener is a tab.

F5. The pipette tip tray of embodiment F3 or F4, wherein the orifice fastener is a slot.

F6. The pipette tip tray of any one of embodiments F1 to F5, wherein the fastener component in association with the edge of the lid associates with the fastener component in association with the rack in a slidable fit, reversible fit, snap fit, interference fit or combination thereof.

The entirety of each patent, patent application, publication and document referenced herein hereby is incorporated by reference. Citation of the above patents, patent applications, publications and documents is not an admission that any of the foregoing is pertinent prior art, nor does it constitute any admission as to the contents or date of these publications or documents.

Modifications may be made to the foregoing without departing from the basic aspects of the technology. Although the technology has been described in substantial detail with reference to one or more specific embodiments, those of ordinary skill in the art will recognize that changes may be made to the embodiments specifically disclosed in this application, yet these modifications and improvements are within the scope and spirit of the technology.

The technology illustratively described herein suitably may be practiced in the absence of any element(s) not specifically disclosed herein. Thus, for example, in each instance herein any of the terms "comprising," "consisting essentially of," and "consisting of" may be replaced with either of the other two terms. The terms and expressions which have been employed are used as terms of description and not of limitation, and use of such terms and expressions do not exclude any equivalents of the features shown and described or portions thereof, and various modifications are possible within the scope of the technology claimed. The term "a" or "an" can refer to one of or a plurality of the elements it modifies (e.g., "a reagent" can mean one or more reagents) unless it is contextually clear either one of the elements or more than one of the elements is described. The term "about" as used herein refers to a value within 10% of the underlying parameter (i.e., plus or minus 10%), and use of the term "about" at the beginning of a string of values modifies each of the values (i.e., "about 1, 2 and 3" refers to about 1, about 2 and about 3). For example, a weight of "about 100 grams" can include weights between 90 grams and 110 grams. Further, when a listing of values is described herein (e.g., about 50%, 60%, 70%, 80%, 85% or 86%) the listing includes all intermediate and fractional values thereof (e.g., 54%, 85.4%). Thus, it should be understood that although the present technology has been specifically disclosed by representative embodiments and optional features, modification and variation of the concepts herein disclosed may be resorted to by those skilled in the art, and such modifications and variations are considered within the scope of this technology.

Certain embodiments of the technology are set forth in the claim(s) that follow(s).

What is claimed is:

1. A pipette tip tray, comprising:

a top comprising an array of bores, each bore configured to receive a partially-inserted pipette tip;

a base with sides, wherein a side comprises a step around the base perimeter and at least one slot in the step; and a lid comprising at least one molded tab extending from the lid, wherein:

the at least one tab is inserted in the at least one slot;

the tab and slot form an internal hinge, the tab is flexible, the tab comprises the same material as the lid;

the tab is in flexible association with the lid at a junction between the tab and the bottom edge of the lid, and the hinge is configured for the lid to pivot around the junction.

2. The pipette tip tray of claim 1, wherein the side comprises two slots and the lid comprises two tabs.

3. The pipette tip tray of claim 1, wherein a side including the step and the slot in the step are located on a short side of the tray.

4. The pipette tip tray of claim 1, wherein a side including the step and the slot in the step are located on a long side of the tray.

5. The pipette tip tray of claim 1, wherein the tab associates with the slot in a slidable fit.

6. The pipette tip tray of claim 1, wherein the tab is engaged in the slot and the lid is in an open position at an angle sufficient to allow access to the pipette tips.

7. The pipette tip tray of claim 1, wherein the tab is engaged in the slot and the lid is in a partially open position at an angle sufficient to allow access to the pipette tips.

8. The pipette tip tray of claim 1, wherein the tab extends below the plane of the step around base perimeter when engaged.

9. The pipette tip tray of claim 1, wherein the tab is configured for reversible engagement with the slot.

10. The pipette tip tray of claim 1, wherein the lid and the tab are configured for the lid to pivot with respect to the tray about the junction between the tab and the lid when the tab is engaged in the slot.

* * * * *